US010036128B2

(12) United States Patent
Salciccia

(10) Patent No.: US 10,036,128 B2
(45) Date of Patent: Jul. 31, 2018

(54) TAMPING MACHINE FOR RAILWAY BALLASTS, RAILWAY CAR AND USE OF TAMPING MACHINE FOR MAKING AND REGENERATING RAILWAY BALLASTS

(71) Applicant: SRT SOCIETA' A RESPONSABILITA' LIMITATA CON SOCIO UNICO, Rome (IT)

(72) Inventor: Gilberto Salciccia, Rome (IT)

(73) Assignee: SRT SOCIETA' A RESPONSABILITA' LIMITATA CON SOCIO UNICO, Rome (IT)

( * ) Notice: Subject to any disclaimer, the term of this patent is extended or adjusted under 35 U.S.C. 154(b) by 247 days.

(21) Appl. No.: 14/952,906

(22) Filed: Nov. 25, 2015

(65) Prior Publication Data

US 2016/0153150 A1 Jun. 2, 2016

(30) Foreign Application Priority Data

Nov. 27, 2014 (IT) ..... MI2014A2043

(51) Int. Cl.
*E01B 27/16* (2006.01)
*B06B 1/18* (2006.01)

(52) U.S. Cl.
CPC ..... *E01B 27/16* (2013.01); *B06B 1/18* (2013.01)

(58) Field of Classification Search
CPC ..... E01B 27/00; E01B 27/02; E01B 27/028; E01B 27/12; E01B 27/13; E01B 27/14; E01B 27/16; E01B 27/20
See application file for complete search history.

(56) References Cited

U.S. PATENT DOCUMENTS

2006/0090666 A1* 5/2006 Theurer ..... E01B 27/16 104/12
2009/0193965 A1* 8/2009 Paluncic ..... F16N 25/02 92/61

FOREIGN PATENT DOCUMENTS

CH 597522 7/1975
EP 1653003 8/2005

OTHER PUBLICATIONS

Search Report for Italian Application MI20142043 (dated Nov. 27, 2014).

* cited by examiner

*Primary Examiner* — Robert J McCarry, Jr.
(74) *Attorney, Agent, or Firm* — Nixon & Vanderhye P.C.

(57) ABSTRACT

A tamping machine, particularly for regenerating railway ballasts, includes: a supporting frame, a vibrating tamping hammer pivoted to the frame, and a hydraulic actuator engaged with a thrusting portion of the tamping hammer. The actuator includes first and second axially aligned sections engaged with each other, one of which is engaged with the thrusting portion of the tamping hammer and the other section is engaged with an abutment portion. The first section is extendable while the second section is supplied by distributing means having an alternate cyclical operation for enabling the tamping hammer to vibrate. The second section is a jacket extending between a first and second longitudinal ends, and a piston slidingly movable inside the jacket. The jacket is closed at the first and second longitudinal ends; the piston exhibits an overall axial size defined by respective thrusting opposite faces of the piston itself, which is entirely contained inside the jacket.

35 Claims, 9 Drawing Sheets

TAMPING MACHINE FOR RAILWAY BALLASTS, RAILWAY CAR AND USE OF TAMPING MACHINE FOR MAKING AND REGENERATING RAILWAY BALLASTS

RELATED APPLICATION

This application claims priority of Italian Patent Application Number MI2014A002043 filed on 27 Nov. 2014, the entirety of which is incorporated by reference.

FIELD OF THE INVENTION

The present invention refers to a tamping machine for railway ballasts, a railway car and an use of the same tamping machine for making and/or regenerating railway ballasts. The present invention finds its application in the railway field and, particularly, in the technical field of machines destined to construct, service and dismantle railway lines.

STATE OF THE ART

Towed or self-propelled cars are used for making and/or regenerating railway ballasts, they are provided with groups of tamping machines arranged inside and outside each rail according to arrangements known as simple and double head (tamping machines using more than two heads, for example 4 or also 16 heads are known). Each tamping machine is generally provided with two pairs of vibrating hammers which are sunk into the ballast from one side and the other of each sleeper in order to mix and fluidify the rocks and tamp by it the sleeper itself.

Known tamping machines are provided of purely mechanical vibrating systems using eccentric masses or mechanisms for causing the hammers to vibrate and sink into the ballast. However, these systems exhibit different drawbacks and limitations due to the (mechanical) nature of the same. A drawback of these tamping machines is due to the vibrating system (eccentric masses/mechanisms) causing high stresses to the mechanical members forming the system itself; therefore, in order to sustain this vibration, the system must be suitably sized and provided with a strong structure, such characteristic generally makes the system complex and expensive to be manufactured. Therefore, these characteristics dictate the limits in terms of vibration frequency which—for preventing excessive stresses damaging the members of the system itself—must fall between determined low limits: the low vibration frequency of the hammers negatively affects also the capability/rapidity of tamping ballasts.

Moreover, it is noted that the above described known machines, whose vibration is simultaneously transmitted to all the hammers pairs of each "head" (the term head means a group of elements operating on each sleeper). This instance is a substantial inconvenience because it causes to build railway cars provided with two different types of vibrating systems respectively adapted to operate on a straight-track and on points; the first (straight-track systems) are of a double head type and are capable of simultaneously operate on two sleepers, while the second (railway points systems) have necessarily only one head and when they are used on straight tracks they do not exhibit an adequate performance: it is just this latter aspect which requires to prepare different cars for straight tracks and for points.

Therefore, new tamping machines, for example described in the patent application No. TO1988A067194, have being developed, which comprise at least one operative head provided with at least two pairs of tamping vibrating hammers each constrained to a support oscillatingly pivoted to a frame of the machine and subjected to the action of hydraulic actuators (hydraulic cylinders).

The actuator exhibits a first and second sections serially connected to each other; the first section is extendable and is adapted to displace the tamping hammer from a substantially vertical working position to a substantially horizontal reversed exclusion position. The second section, in line with the first section, is supplied by distributing means having an alternate cyclical operation and it is adapted to subject the first actuator section and the associated tamping hammer to a corresponding alternated cyclical vibration.

The machine described in the above mentioned patent application, further comprises hydraulic control means configured for controlling the supply of the first section of the actuators in order to enable to selectively displace, by a command of each hammer, from the working position to the exclusion one, and vice versa. Moreover, there are further hydraulic control means configured for managing the supply of the second section of the actuators also based on the position (working or exclusion position) of the tamping hammer.

The solution described in the patent application No. TO1988A067194 is an improvement with respect to the known art described beforehand because it exhibits a substantially simplified structure and is more stable enabling the tamping machine to work at high frequencies (also variable in a wide range of values selectable with respect to the state of the ballast to be regenerated) sharply greater than the one imposed by the known mechanical systems; in addition it is to be noted that the substitution of mechanisms and eccentric masses with hydraulic actuators has substantially reduced the generation of undesired vibrations and therefore of structural stresses. The simplified structure is also positively characterized from the point of view of the size and weights, certainly smaller than the ones of the previous mechanical systems, enabling to implement more compact railway cars having constrained weight and size.

In addition, it is noted that the use of hydraulic actuators makes the tamping machine more flexible from the point of view of its use: the movement of the actuators excluding/operating only some hammers enables to provide only one type of car adapted to execute both the straight-track work and the points work with clear advantages in terms of running and maintenance costs; this latter characteristic enables to further reduce the work times and avoid to substitute the straight-track cars with the points cars, and vice versa.

However, even though the machine described in the above mentioned patent application is an improvement with respect to the mechanical systems, however these hydraulic machines are not devoid of drawbacks. De facto, a first drawback is related to the size of the actuators responsible for actuating the hammers: the structures of the in-series sections (first and second sections) determine a considerable axial size of the actuators. De facto, the length of each single actuator is obtained by summing the axial size of the two sections composing it; the fact of providing a so bulky actuator for moving each hammer surely makes the machine structure complex and difficult to be designed. Due to this drawback (substantial length) the actuators are usually horizontally placed on the machine, which in turn substantially affects the size of each head; this prevents to manufacture heads having more than two pairs of hammers.

It is also known from the patent application No. TO99A000425 hydraulic tamping machines substantially of the above described type and particularly comprising at least one working head provided with at least two pairs of vibrating tamping hammers each constrained to a support oscillatingly pivoted to the machine frame and subjected to the action of a hydraulic actuator (hydraulic cylinder).

Also these machines substantially exhibit a first and second sections respectively dedicated to extend the hammer and vibrate this latter. In comparison with the first cited patent application, these second machines exhibit a first and second sections radially located one from the others.

More specifically, the first section comprises a cylinder, exhibiting a predetermined longitudinal extension and a predetermined diameter, configured for enabling to extend the hammer; the second section comprises a second cylinder defined around the first cylinder; the outer wall of the first cylinder defines also an inner lateral part of the second cylinder.

Hydraulic distributing means and associated control means are provided for this latter tamping machine. De facto, also this second machine comprises hydraulic control means configured for controlling the supply of the first section (first inner cylinder) of the actuators for enabling a selective displacement, commanded by each hammer, from the working position to the exclusion one, and viceversa. In addition, further hydraulic control means configured for managing the supply of the second section (second outer radial cylinder) of the actuators also based on the position (working or exclusion position) of the tamping hammer are provided.

Also the machines described in the second patent application No. TO99A000425, exhibit, with respect to the above discussed mechanical systems, the advantages of the hydraulic tamping machines described in the first patent application No. TO1988A067194. However, in support of the machines described in the second cited patent application, these are equipped with actuators having a reduced axial size: the arrangement of the second cylinder around the first cylinder makes the axial sizes to be substantially defined by the length of this latter. The reduced size of the actuators enables to simplify the design of the heads and possibly to provide more than two pairs of hammers on each head.

However, also the tamping machines described in the above mentioned patent application, are not devoid of limitations and drawbacks. De facto, the arrangement of the second cylinder around the first cylinder entails a great power loss for the vibrating system: in fact it is necessary a high hydraulic power for operating the outer cylinder.

SUMMARY OF THE INVENTION

The Applicant has noted that, although the above cited machines enable to tamp railway ballasts, the same however are not devoid of some drawbacks and are improvable under different aspects. De facto, to date hydraulic actuator tamping machines having a compact structure and at the same time having high performances, in other words machines of a simple structure and capable of exploiting small powers for tamping railway ballasts are not known yet.

A novel structurally simple tamping machine has been invented and is disclosed herein having a limited size, particularly adapted to enable to provide railway cars having a reduced weight and size with respect to the known solutions. The size reduction of the tamping machines, object of the present invention, is further adapted to enable to assemble many tamping hammers on each head of the machine so that, if required, this latter can simultaneously work on consecutive sleepers of a track.

The tamping machine having a flexible use and particularly configured for operating with high and variable frequencies in a wide range of values selectable in relation to the state of the ballast to be regenerated. Particularly, it is an object of the invention to provide a tamping machine whose structure avoids the generation of unacceptable structural stresses in favour of a substantial increase of the performance.

The tamping machine may include high efficiency whose actuators—and consequently the hammers—are capable of suitably regenerating the ballasts also by reduced powers.

The tamping machine may be configured for enabling to implement a unique type of car adapted to execute both the straight-track work and the points work with clear advantages in terms of operating and maintenance costs while substantially reducing the operative execution times (during the working step, it is avoided the substitution of the straight-track cars with the points cars, and vice versa). Further, it is an object of the present invention to provide a tamping machine enabling to easily and efficiently monitor the elements directly responsible of the ballast tamping and therefore to define a machine which can be effectively monitored and managed. Then, the tamping machine may be used to verify the soundness of a railway ballast and possibly signal a fail when the condition of this latter does not fall into desired parameters.

In a first aspect, the novel tamping machine (1), particularly for regenerating railway ballasts, comprises:

(i) at least one supporting frame (2) associable above at least one railway track, said railway track being of a type comprising at least two rails and a plurality of sleepers, (ii) at least one tamping hammer (3) extending along a prevalent development direction (D) between an operative portion (3*a*) and a thrusting portion (3*b*) and (iii) at least one hydraulic actuator (4).

The tamping hammer (3) may include an engaging portion (3*c*), interposed between the operative portion (3*a*) and thrusting portion (3*b*), pivoted to the frame (2) and adapted to enable a relative rotation of the hammer (3) with respect to the frame (2), the tamping hammer (3) being configured for being arranged at least in a working and an immediately following one along the track, the hammer (3), in the working condition, being configured for being arranged transversally to the tracks and sleepers, particularly vertically to the ballast, the operative portion (3*a*) facing said ballast (M), the tamping hammer (3) being further configured for being placed at least in one exclusion or receiving condition wherein the hammer (3) is substantially positioned horizontally or in a sloped position with respect to the working position suitable for defining a starting position for tamping the sleeper (T).

The at least one hydraulic actuator (4) may be engaged, on a side, with the thrusting portion (3*b*) of the tamping hammer (3) and, on the other side, with an abutment portion, the actuator (4) comprising at least one first and one second sections (5, 6), axially aligned and engaged with each other, one of said first and second sections (5, 6) being engaged with the abutment portion while the other being engaged with the thrusting portion (3*b*) of the tamping hammer (3), the first section (5) being extendable and configured for moving the hammer (3) at least between the working condition and the receiving or exclusion condition, and vice versa, the second section (6) being configured for being powered by distributing means having a cyclic alternating operation for enabling the tamping hammer (3) to vibrate, the second section (6) comprising at least one jacket (7) extending between a first and second longitudinal ends (7*a*, 7*b*) and at least one piston (8) slidingly movable inside the jacket (7), the jacket (7) is closed at the first and second longitudinal ends (7*a*, 7*b*), the piston (8) having an overall axial size defined by respective opposite thrusting faces of the piston (8) itself, which is entirely contained inside the jacket (7).

In a 2nd aspect according to the aspect 1, the jacket (7) of the second section (6) is engaged, particularly directly, with the frame (2) or the thrusting portion (3*b*) of the tamping hammer (3).

In a 3rd aspect according to anyone of the preceding aspects, the piston (8) is constrained to the tamping hammer (3) or frame (2) by interposition of the jacket (6), particularly the piston (8) is not directly engaged with the tamping hammer (3) and/or frame (2).

In a 4th aspect according to anyone of the preceding aspects, the jacket (7), at said first and second longitudinal ends (7*a*, 7*b*), comprises respective fluid-tight blind plugs, particularly devoid of passage openings, the piston (8) being entirely contained in the jacket (7) and entirely interposed between said blind plugs.

In a 5th aspect according to anyone of the preceding aspects, the piston (8) comprises only a head entirely contained in the jacket (7), particularly the piston (8) is devoid of a stem and does not exhibit parts projecting from the longitudinal ends of the jacket (7).

In a 6th aspect according to anyone of the preceding aspects, the first section (5) comprises at least one jacket (9) extending between a first and second longitudinal ends (9*a*, 9*b*) and at least one piston (10) slidingly movable inside said jacket (9), the jacket (9) of the first section (5) being engaged with the piston (8) of the second section (6) and being movable in relation to the jacket (7) of said second section (6).

In a 7th aspect according to the preceding aspect, the jackets (9, 7) of the respective first and second sections (5, 6) are axially aligned one with the other.

In an 8th aspect according to the aspect 6 or 7, the second longitudinal end (7*b*) of the jacket (7) of the second section (6) faces the second longitudinal end (9*b*) of the jacket (9) of the first section (5), the second ends (7*b*, 9*b*) of the jackets (7, 9) of the respective sections (5, 6) are relatively movable by approaching each other and moving away from each other.

In a 9th aspect according to anyone of the preceding aspects, the second section (6) comprises at least one connecting element (11) stably constrained to and transversally emerging from the piston (8) of the second section (6) itself, the jacket (7) of the second section (6) comprising at least one longitudinal through groove (12) arranged on a lateral wall of said jacket (7) between the first and second longitudinal ends (7*a*, 7*b*) of the same, the connecting element (11) of the piston (8) passing through and being slidingly axially engaged inside the longitudinal groove (12), and wherein the jacket (9) of the first section (5) comprises at least one anchoring portion (13) engaged with the connecting element (11) of the second section (6), the jacket (9) of the first section (5) being, with the piston (8) and connecting element (11) of the first section (6), relatively movable with respect to the jacket (7) of said second section (6).

In a 10th aspect according to the preceding aspect, the anchoring portion (13) extends as an axial continuation of the jacket (9) of the first section (5) outside the jacket (7) of the second section (6), particularly the anchoring portion (13) extending parallelly to a longitudinal development direction of the jacket (7) of the second section (6).

In an 11th aspect according to the aspect 9 or 10, the jacket (7) of the second section (6) comprises two longitudinal through grooves (12) made opposite one to the other on the lateral wall of said jacket (7), the connecting element (11) passing through and being axially slidingly engaged inside both the longitudinal grooves (12).

In a 12th aspect according to anyone of the aspects from 9 to 11, the anchoring portion (13) of the first section (5) is at least partially countershaped to the jacket (7) of the second section (6) in order to cover at least partially this latter.

In a 13th aspect according to the aspect 11 or 12, the anchoring portion (13) is stably engaged with the connecting element (11) which is slidingly engaged inside both the longitudinal grooves (12).

In a 14th aspect according to anyone of the aspects from 9 to 13, the anchoring portion (13) substantially comprises a tubular jacket at least partially covering the outside of the jacket (7) of the second section (6).

In a 15th aspect according to anyone of the aspects from 6 to 14, the piston (10) of the first section (5) comprises a head (14) slidingly movable inside the jacket (9) of the first section (5) itself and a stem (15) connected to the head (14) and emerging from the first longitudinal end (9*a*) of the jacket (9) of the first section (5), a portion of the stem (15) emerging from the jacket (9) of the first section (5) being stably constrained to the frame (2) or to a thrusting portion (3*b*) of a hammer (3).

In a 16th aspect according to anyone of the preceding aspects, the first section (5) comprises a double-acting cylinder.

In a 17th aspect according to anyone of the preceding aspects, the machine (1) comprises:

at least one power supply, particularly a generator defined by a pump-motor group, first hydraulic control means (16) connected to the power supply and configured for selectively distributing the fluid to the first section for enabling the displacement of the tamping hammer (3) from the working condition to the receiving or exclusion one, and vice versa.

In an 18th aspect according to the preceding aspect, the first hydraulic control means (16) are configured for managing the supply of the respective supply chambers of the double-acting cylinder of the first section (5).

In a 19th aspect according to the aspect 17 or 18, the first hydraulic control means (16) comprise a group of switching solenoid valves, particularly having a blocking intermediate position.

In a 20th aspect according to anyone of the aspects from 17 to 19, the first hydraulic control means (16) comprise a switching box, particularly the switching box being of a type comprising at least one selected in the group of the following commands: manual, hydraulic, mechanical, electronic, air-actuated.

In a 21st aspect according to anyone of the preceding aspects, the second section (6) comprises a double-acting cylinder.

In a 22nd aspect according to anyone of the preceding aspects, the machine comprises:

at least one power supply, particularly a generator defined by a pump-motor group, second hydraulic control means (17) connected to the power supply and configured for selectively supply the second section (6) and enabling the oscillation, and therefore the vibration, of the tamping hammer (3) around the engagement portion (3*c*).

In a 23rd aspect according to the preceding aspect, the second hydraulic control means (17) are configured for managing the supply of the respective supply chambers of the double-acting cylinder of the second section (6).

In a 24th aspect according to the aspect 22 or 23, the second hydraulic control means (17) comprise a group of switching solenoid valves, particularly of the two-way and two-position type.

In a 25th aspect according to anyone of the aspects from 22 to 24, the second hydraulic control means (17) comprise a commutator configured for selectively supplying the second section (6) of the type comprising at least one selected in the group of the following commands: manual, hydraulic, mechanical, electronic, air-actuated.

In a 26th aspect according to anyone of the aspects from 22 to 25, the first hydraulic control means (16) are configured for excluding the second hydraulic control means (17) and, therefore, the supply of the second section (6), in the receiving or exclusion condition of the tamping hammer (3).

In a 27th aspect according to the preceding aspect, the first and second sections (5, 6) of the actuator (4) are mechanically serially connected to each other.

In a 28th aspect according to anyone of the preceding aspects, the piston (8) of the second section (6) comprises a cylindrical body longitudinally delimited by the respective faces of the of the first and seconds ends (8*a*, 8*b*) of the same piston (8) which define the respective thrusting faces of this latter, the opposite thrusting faces of the piston (8) of the second section (6) exhibiting substantially the same thrusting surface.

In a 29th aspect according to anyone of the preceding aspects, the thrusting surface of both the longitudinal opposite faces of the piston (8) exhibits an area comprised between 5 and 200 centimeters squared (cm2), still more particularly between 20 and 100 cm2, still more particularly between 50 and 100 cm2.

In a 30th aspect according to anyone of the preceding aspects, the faces of the first and second ends (8*a*, 8*b*) of the piston (8) define, cooperatively with the inner lateral wall and respective ends (7*a*, 7*b*) of the jackets (7) of the second section (6), respective chambers (18, 19), each said respective chamber exhibits a varying volume according to the relative position taken by the piston (8) of the second section (6) in relation to the jacket (7) of this latter section.

In a 31st aspect according to the preceding aspect, the maximum volume definable by each of said chambers is substantially equal, particularly wherein the minimum volume definable by said chambers is substantially equal.

In a 32nd aspect according to the aspect 30 or 31, the maximum volume definable by each chamber is comprised between 20 and 100 cm3, particularly between 20 and 70, still more particularly comprised between 25 and 35 cm3.

In a 33rd aspect according to anyone of the aspects from 30 to 32, the minimum volume definable by each chamber is comprised between 0 and 20 cm3, particularly is comprised between 0 and 10 cm3.

In a 34th aspect according to anyone of the aspects from 6 to 33, the jacket (9) of the first section defines a predetermined transversal passage area greater than a transversal passage area of the jacket (7) of the second section (6).

In a 35th aspect according to anyone of the aspects from 6 to 34, the transversal passage area of the jacket (9) of the first section (5) is comprised between 30 and 250 cm2, particularly between 40 and 150 cm2, still more particularly between 40 and 80 cm2.

In a 36th aspect according to anyone of the preceding aspects, wherein the transversal passage area of the jacket (7) of the second section (6) is comprised between 5 and 200 cm2, still more particularly between 20 and 100 cm2, still more particularly between 50 and 100 cm2.

In a 37th aspect according to anyone of the preceding aspects, the maximum axial stroke of the piston (8) of the second section (6) is comprised between 5 and 30 mm, particularly between 10 and 25 mm.

In a 38th aspect according to anyone of the aspects from 6 to 37, the piston (10) of the first section (5) exhibits a maximum axial stroke greater than a maximum axial stroke of the piston (8) of the second section (6), particularly the ratio of the maximum axial stroke of the piston (10) of the first section (5) to the maximum axial stroke of the piston (8) of the second section (6) is greater than 2, particularly is comprised between 4 and 10.

In a 39th aspect according to anyone of the aspects from 6 to 38, the maximum axial stroke of the piston (10) of the first section (5) is comprised between 50 and 600 mm, particularly between 60 and 250 mm, still more particularly between 80 and 150 mm.

In a 40th aspect according to anyone of the preceding aspects, the machine (1) comprises at least two tamping hammers (3) facing each other and configured for being located at a predetermined distance measured along the development of the tracks, each tamping hammer (3) being configured for moving between the working position and the receiving or exclusion position, particularly around the respective engagement portion (3*c*).

In a 41st aspect according to the preceding aspect, the pair of tamping hammers (3) are connected and moved by a single actuator (4) exhibiting the first section (5) engaged with a thrusting portion (3*b*) of a hammer (3) and the second section (6) connected to the other tamping hammer (3).

In a 42nd aspect according to the preceding aspect, the only actuator (4) constrained to the pair of hammers (3) exhibits the jacket (7) of the second section (6) connected to a thrusting portion (3*b*) of a hammer (3) and the piston (10) of the first section (5) connected to the thrusting portion (3*b*) of the other hammer (3).

In a 43rd aspect according to anyone of the aspects from 1 to 40, the machine (1) comprises at least two hydraulic actuators (4) each dedicated to move a tamping hammer (3) of said pair of hammers (3), each of said actuators (4) being engaged, on one side, with the frame (2) and, on the other side, with the thrusting portion (3*b*) of a tamping hammer (3), one of said first and second sections (5, 6) of each actuator being engaged with the frame (2), while the other being engaged with the thrusting portion (3*b*) of the tamping hammer (3).

In a 44th aspect according to anyone of the aspects from 40 to 43, the tamping hammers (3) of a pair of hammers, in the working condition, are configured for being vertically located with respect to the ballast or are configured for being slightly sloped with respect to each other, the operative portions (3*b*) being located at a distance less than the distance between the respective thrusting portions (3*a*), particularly, the respective prevalent development directions (D) of the pair or tamping hammers (3) define between them an oblique angle substantially comprised between 5° and 50°, particularly 10° and 40°.

In a 45th aspect according to anyone of the aspects from 40 to 44, the tamping hammers (3) of the pair of hammers, in the receiving condition, are configured for being slightly sloped with respect to each other, the operative portions (3*b*) located at a distance greater than the distance between the respective thrusting portions (3*a*), particularly, the respective prevalent development directions (D) of the pair of tamping hammers (3) define between them an oblique angle substantially comprised between 5° and 50°, particularly between 10° and 40°.

In a 46th aspect according to anyone of the preceding aspects, the piston (8) of the second section (6) is devoid of seals, particularly there are no seals between the jacket (7) and the piston (8) of the second section (6).

In a 47th aspect according to anyone of the preceding aspects the machine (1) comprises at least one transducer (25) engaged on the actuator (4) and configured for generating a signal in relation at least to the movement and the force expressed by the same actuator (4).

In a 48th aspect according to anyone of the preceding aspects, the machine (1) comprises at least one control unit connected to the transducer (25) and configured for receiving the signal from this latter and monitoring at least one of the following conditions of the actuator:

- the position of the tamping hammer (3) with respect to the frame (2) or with respect to another hammer (3),
- the vibration frequency of the actuator,
- the force exerted by the actuator and therefore the stress for tamping the ballast.

In a 49th aspect according to the preceding aspect, the control unit is connected to the power supply of the actuator (4) and to the hydraulic control means, the control unit being configured for managing the operation of the power supply and of the hydraulic control means for managing and controlling the movement and operation of the first and second sections (5, 6) of the actuator (4).

In a 50th aspect, it is provided a railway car (100) comprising at least one tamping machine (1) according to anyone of the preceding aspects, said railway car (100) comprising at least one supporting structure (101) supporting at least four wheels configured for enabling the abutment and the engagement of the structure (101) on rails of a railway track, the frame (2) of the tamping machine (1) being movably constrained to the supporting structure (101), said frame (2) being configured for translating from a raised position wherein the frame (2) itself is located in proximity with the structure (101) to a lowered position wherein the frame (2) itself is more spaced from the structure (101) than at the retracted position, and vice versa, and wherein the hammers (3) of the tamping machine (1), placed in the working condition, are configured for being spaced from the railway ballast when the frame (2) is in the raised position, and wherein the hammers (3) of the tamping machine (1), placed in the working condition, are configured for sinking at least partially in the railway ballast when the frame (2) is in the lowered position.

In a 51st aspect according to the preceding aspect, the car (100) comprises at least one hydraulic cylinder (102) engaged, on one side, with the supporting structure (101) and, on the other side, with the frame (2), said hydraulic cylinder being configured for moving said frame at least between the raised position and the lowered position, and vice versa.

In a 52nd aspect, it is provided the use of a tamping machine (1) according to anyone of the aspects from 1 to 49 for regenerating railway ballasts and particularly for tamping the track, consisting in taking to a determined level the tracks with respect to the ballast.

BRIEF DESCRIPTION OF THE DRAWINGS

Some embodiments and some aspects of the invention will be described in the following with reference to the attached drawings, given only in an indicative and therefore non limiting way, wherein.

DETAILED DESCRIPTION

A tamping machine 1 is disclosed for making and/or regenerating railway ballasts M; particularly, finds an application in the railway field and, particularly, in the technical field of machines destined to construct, service and dismantle railway lines.

To better comprehend the structure and operation of the tamping machine 1, it is useful to specify that it is configured for being generally mounted on railway cars 100 (FIG. 1) of the type comprising a supporting structure 101 supporting at least four wheels configured for enabling the abutment and the engagement of the structure 101 with rails of a railway track: the supporting structure 101 (FIG. 1) substantially defines a truck abutting on the rails of a track configured for supporting (transporting) components of the car 100. The tamping machine 1, object of the present invention, is configured for being engaged with the supporting structure 101 of the car 100 so that the same can be transported by the car 100 (FIG. 1) and can operate for tamping railway ballasts M.

Figure 2:
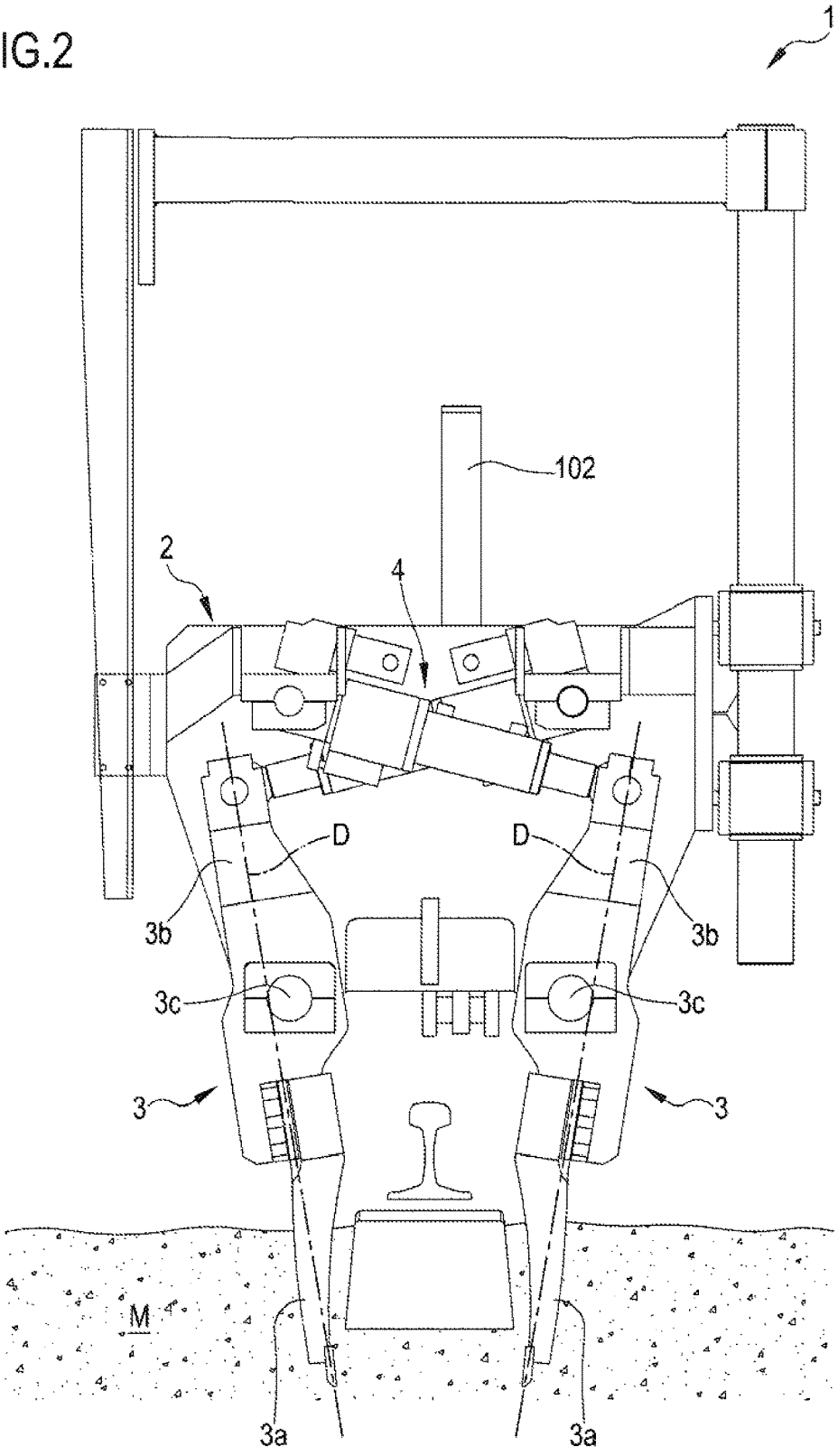
FIG. 2 is a front view of a detail of a tamping machine according to the present invention.
Figure 3:
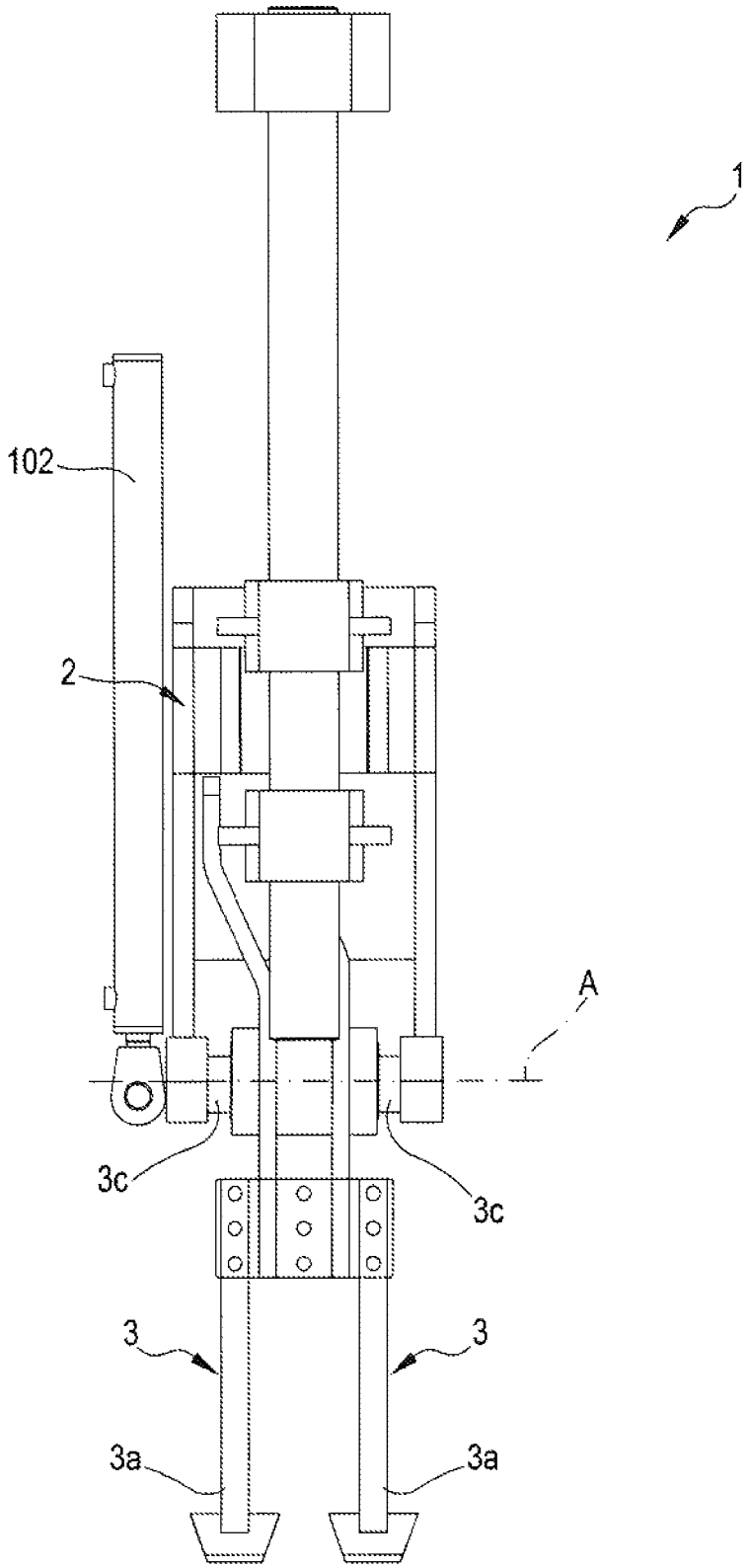
FIG. 3 is a lateral view of a tamping machine according to the present invention.
Figure 4:
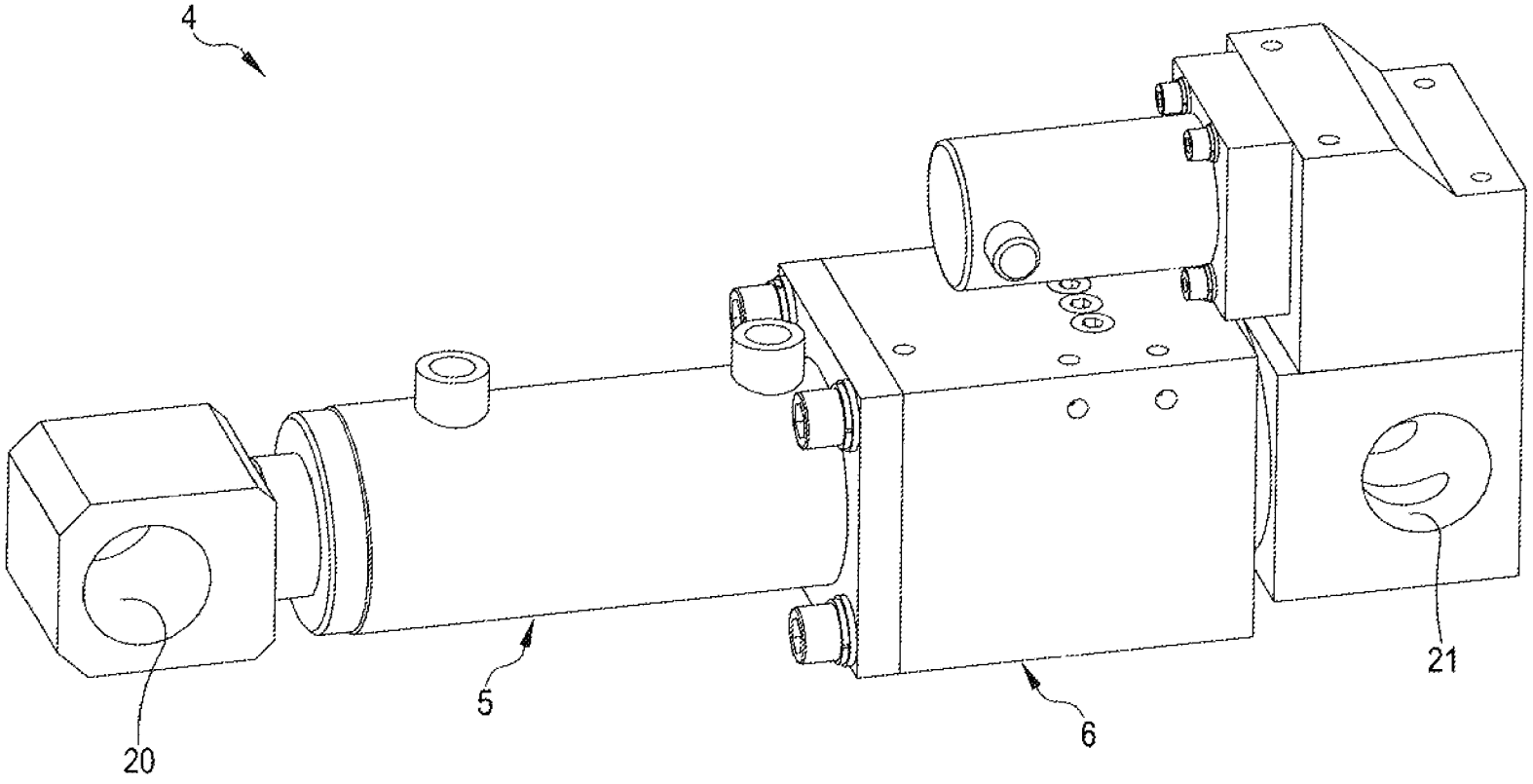
FIG. 4 is a perspective view of an actuator of a tamping machine according to the present invention.

In detail and as it is visible from FIGS. 2 and 3, the tamping machine 1 comprises at least one supporting frame 2 associable with the supporting structure 101 of a railway car 100 so that the same frame 2 is placed above the track.

The supporting frame 2, generally made of metal (the frame 2 must ensure a determined strength), can comprise a compact structure adapted to be placed above only one rail or can comprise an extended structure having a certain transversal development enabling the same frame 2 to substantially cover the transversal size of two rails (it exhibits a transversal size substantially equal to the width of the track). FIG. 3 illustrates a preferred but non limiting embodiment of the invention wherein the frame 2 exhibits a compact structure configured for enabling to mount the machine 1 at only one side of the car 100; in this latter arrangement for equipping both sides of the car 100, it would be useful to provide at least one compact tamping machine 1 for each side.

The frame 2 substantially represents the support of the tamping machine 1, which is constrained to the structure 101 of the car 100, in a per se known way, by a suspension strut: the strut is configured for enabling the frame 2 to translate with respect to the supporting structure 101. Particularly, the suspension strut comprises one or more hydraulic cylinders 102 (FIG. 2) adapted to vertically move as a whole the tamping machine 1 for displacing it from a raised position (FIG. 1) to a lowered working position (FIG. 2). As it will be better described in the following, in the raised position, the machine 1 is spaced from the ballast M and enables to transfer the car 100 on the track; in the lowered working position, at least part of the tamping machine 1 is configured for sinking in the ballast M for tamping the sleepers T.

Figure 1:
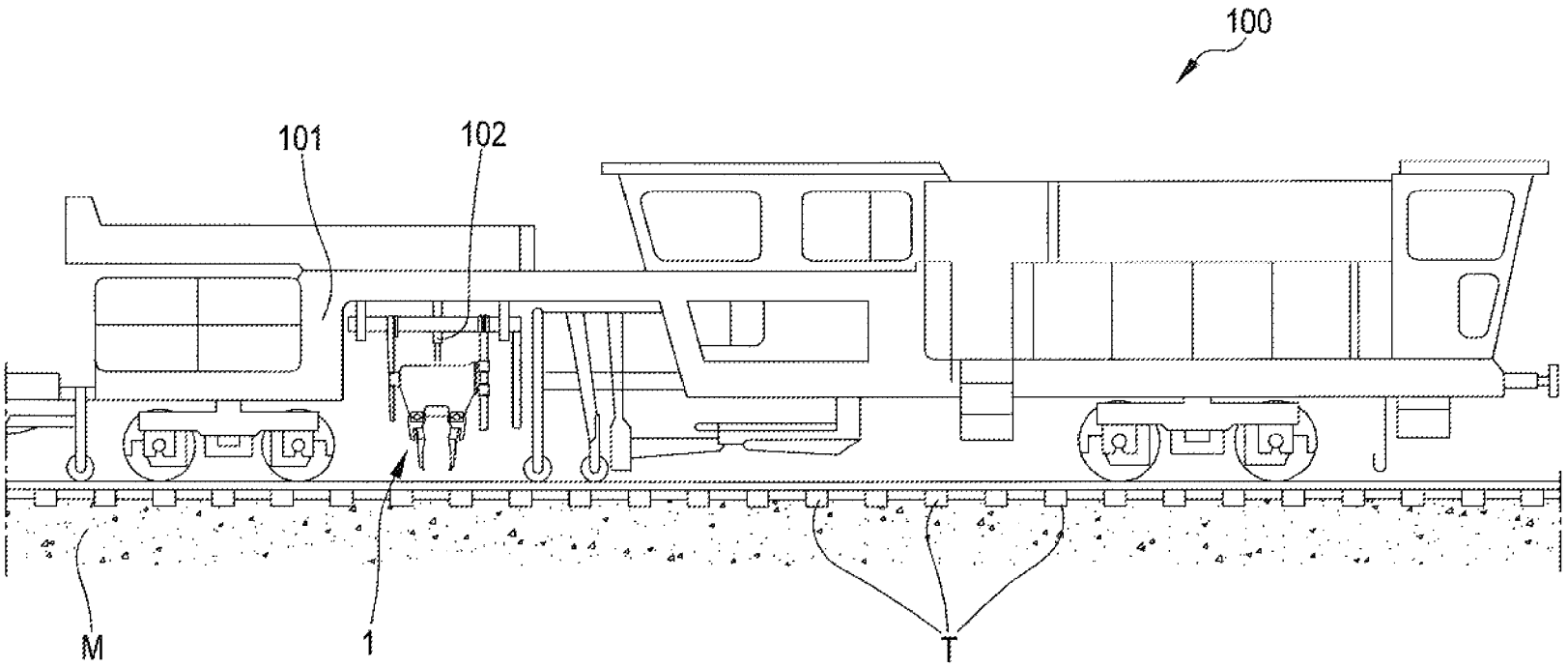
FIG. 1 is a schematic lateral view of a railway car comprising a tamping machine according to the present invention.

As it is for example visible in FIG. 2, the tamping machine 1 comprises at least one tamping hammer 3 engaged at an outside transversal edge of the supporting frame 2. Advantageously, but not in a limiting way, the machine 1 can comprise one or more pairs of hammers 3 both engaged at an outside transversal edge of the supporting frame 2. It is useful to specify that the tamping machine 1 can be provided with only a pair of hammers 3 (tamping the ballast M is advantageously made by using and coordinately move a pair of hammers 3 around a sleeper T of a track) placed on the same side of the railway car 100. However, in a preferred but non limiting embodiment of the invention, the tamping machine 1 comprises two pairs of hammers 3 engaged on opposite sides of the frame 2 and therefore on opposite lateral sides of the car 100 (a pair of hammers for each side): in this way, the tamping machine 1 can execute, with only one step, the tamping of a sleeper. Alternatively, the tamping machine 1 can be provided with two or more pairs of hammers 3 for each side of the frame 2; FIG. 1 illustrates an arrangement of the tamping machine 1 exhibiting, on a same side, two pairs of tamping hammers 3.

Specifically, the hammer 3 comprises an engagement portion 3*c* constrained to a respective engagement portion of the frame 2 placed on a transversal edge of this latter: each hammer 3 is configured for being placed just above a rail. The engagement portion 3*c* of each hammer 3 is configured for defining with the frame 2 a hinge-type constrain: each hammer 3 can rotate in relation to the frame 2 around the engagement portion 3*c*. Particularly, each pair of hammers 3 is hinged on one side of the frame 2. As it is for example visible in FIG. 2, the engagement portion 3*c* of each hammer 3 is configured for defining a rotation axis A (FIG. 3) of the hammer 3 substantially parallel to the ground, particularly substantially horizontal and transversal, specifically normal, to a prevalent development trajectory of the tracks.

As it is specifically visible in FIG. 2, for example, each of said tamping hammers 3 extends along a prevalent development direction D between an operative portion 3*a* and a thrusting portion 3*b*: the engagement portion 3*c* is interposed between the operative portion 3*a* and thrusting portion 3*b*.

Figure 2A:
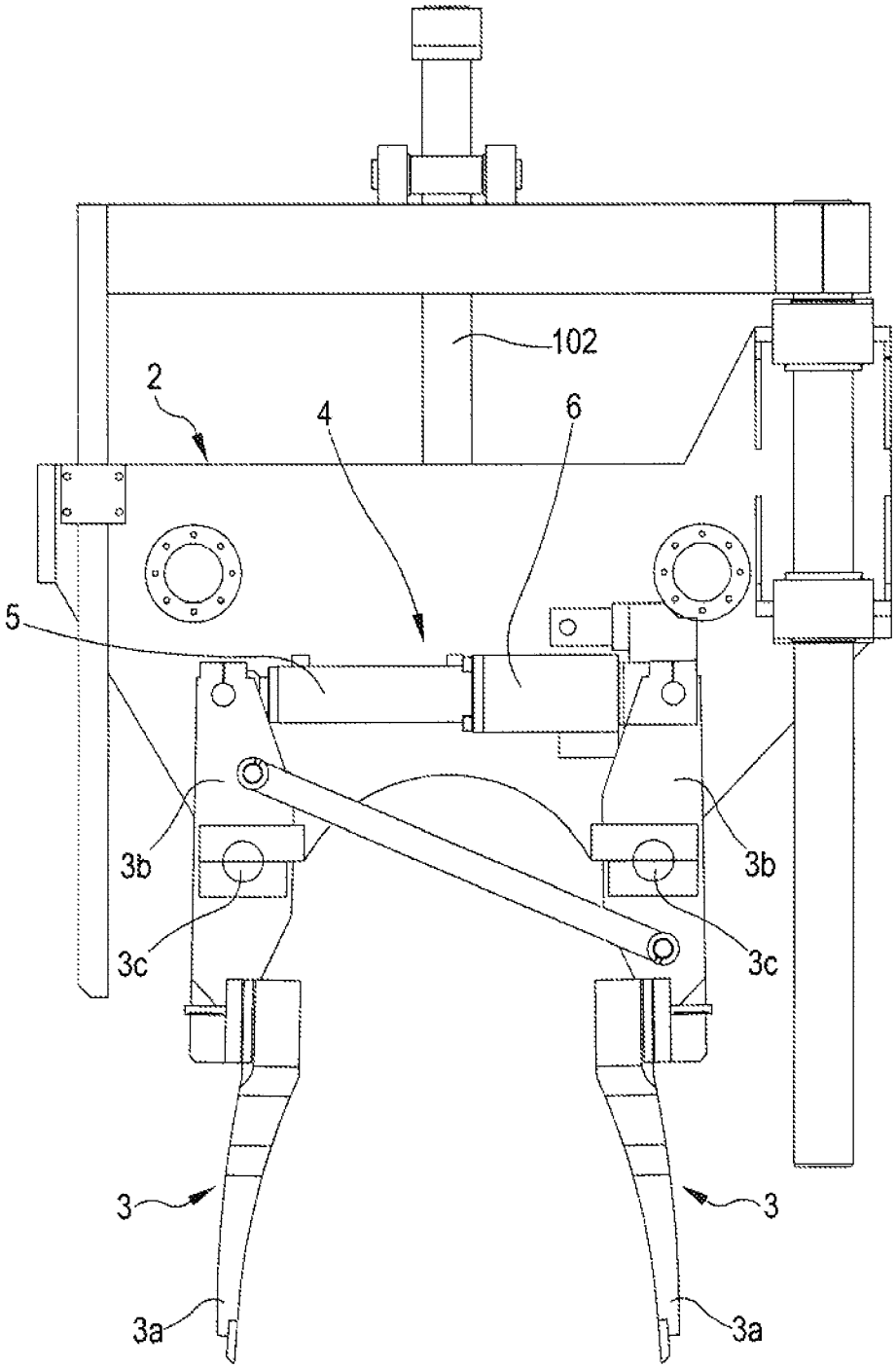
FIG. 2A is a front view of a detail of a further tamping machine according to the present invention.

Each of said tamping hammers 3 is configured for being placed at least in a working condition wherein the hammer 3 is located beside a track between a sleeper T and another immediately following one along the track: the hammer 3, in the working condition, is configured for being placed transversally to the rails and sleepers, particularly normal to the ballast, an operative portion 3 facing said ballast (this working condition is for example illustrated in FIGS. 1 and 2). Further, each tamping hammer 3 is configured for being placed at least in a receiving or exclusion condition wherein the hammer 3 is placed substantially horizontally or in a position sloped with respect to the working position adapted to define a starting position for tamping the sleeper. FIG. 1 schematically illustrates the working condition of a pair of hammers 3 while FIG. 2A illustrates a pair of hammers 3 located in a receiving condition. Each hammer 3 can also be rotated as long as the same moves to an exclusion horizontal position (this condition is not illustrated in the accompanying figures).

It is useful to specify that tamping the railway ballasts M is performed by sinking in the ballasts the operative portion 3*b* of a pair of hammers 3 around a sleeper T. Therefore, in order to enable to sink a pair of hammers 3 into the ballast M, these, in the condition wherein both are placed in the lowered condition, must be located at an predetermined minimum distance greater than the width of a track sleeper T: this enables each pair of hammers 3 to straddle the sleepers T (FIG. 1).

As it is for example visible in FIG. 2, the tamping machine 1 comprises at least one hydraulic actuator 4 engaged with at least one tamping hammer 3. FIG. 2 illustrates a first arrangement of the machine 1 wherein there are two actuators 4, each of them is engaged, on one side, with the frame 2 and, on the other side, with the thrusting portion 3*b* of the tamping hammer 3. Instead, FIG. 2A illustrates a second embodiment of the machine 1 exhibiting an actuator connected to two tamping hammers 3 (with a pair of hammers).

Each actuator 4 comprises at least one first and one second sections 5, 6 axially aligned and engaged with each other. In the first arrangement of the machine 1 (one actuator for each hammer 3) one of said first and second sections 5, 6 is engaged with the frame 2, while the other is engaged with the thrusting portion 3*b* of the tamping hammer 3. In the second arrangement illustrated in FIG. 2A, the hydraulic actuator 4 is engaged with the respective thrusting portions 3*b* of the pair of actuators 4: in this latter arrangement, a section of the actuator is engaged with a thrusting portion 3*b* of a hammer 3, while the other section of the same actuator 4 is engaged with the thrusting portion of the other actuator 4.

De facto, the first section 5 is an extendable portion of the actuator 4, configured for moving the hammer 3 at least between the working condition and the receiving or exclusion condition, and vice versa. The second section 6 is the vibrating portion of the actuator 4 adapted to enable the hammer 3 to vibrate. In other words, the first section 5 is configured for arranging each hammer in a working condition or in an exclusion one, while the second section 6 is configured for inducing a vibration to the thrusting portion 3*b*: the thrusting portion 3*b* vibration propagates from this latter to the operative portion 3*a* for enabling the hammer 3 to sink into the ballast M and tamping the sleepers T.

In detail, the first section 5 comprises an hydraulic double-acting cylinder exhibiting at least one jacket 9 extending between a first and second longitudinal ends 9*a*, 9*b* axially delimiting the cylinder. As it is visible in FIGS. 5-7, for example, the jacket 9 is tightly closed at the second end 9*b*, while at the first end 9*a* the jacket 9 exhibits an opening enabling a piston 10 to pass through and slide, which will be better described in the following.

The jacket 9 exhibits inside a lateral wall in which the piston 10 slides, having a circular cross-section. Advantageously but in a non limiting way, the jacket 9 exhibits as a whole a cylindrical shape.

From the dimensional point of view, the jacket 7 exhibits a general axial extension, defined substantially from the distance between the first and second longitudinal ends 9*a*, 9*b* comprised between 100 and 600 mm, particularly comprised between 200 and 250 mm. However, the inner sliding lateral wall of the jacket 9 exhibits an axial extension comprised between 100 and 300 mm, particularly comprised between 150 and 180 mm. Having still in mind the dimensional aspect of the first section 5, the jacket 9 exhibits, in a non limiting way, a passage cross-section area comprised between 30 and 250 cm2, particularly between 40 and 150 cm2, still more particularly between 40 and 80 cm2. The cross-section passage area means the passage cross-section of the piston 10 defined by the inner lateral sliding wall of the jacket 9.

As hereinbefore specified, the first section 5 comprises a piston 10 slidingly engaged inside the jacket 9. Specifically, the piston 10 substantially comprises a head 14—substantially countershaped to the inner lateral wall of the jacket 9 (cylindrical head)—slidingly moveable inside the jacket 9 and a stem 15 connected to the head 14 (Figures from 5 to 7): the stem 15 emerges from the jacket 9 opening present at the first longitudinal end 9*a* for enabling to constrain the piston 10 to different outside components. Particularly, a portion of the stem 15, emerging from the jacket 9 of the first section 5, comprises at least one constraining element 20 configured for being associated to the frame 2 or the thrusting portion 3*b* of the hammer 3.

The attached figures illustrate a preferred but non limiting arrangement of the invention, wherein the constraining element 20 is directly associated to the thrusting portion 3*b* of the hammer 3. Advantageously, the constraining element 20 can comprise a sleeve or pin adapted to cooperate with a respective pin or sleeve of the thrusting portion 3*b* for defining a hinge-type constrain. Alternatively, the constraining element 20 and thrusting portion 3*b* can comprise a mechanical joint also adapted to define a hinge-type constrain.

The piston 10 of the first section 5 is adapted to divide the inner volume of the jacket 9 in two distinct chambers (not illustrated in the accompanying figures), the volume thereof is variable as a function of the piston 10 position; from the dimensional point of view, the piston 10 stroke is sized in order to enable the passage of the hammer from the working condition to the receiving or exclusion one, and vice versa. Particularly, the piston 10 stroke is comprised between 50 and 600 mm, particularly between 60 and 250 mm, still more particularly between 80 and 150 mm.

Further, the first section 5 comprises at least two through supply conduits (not illustrated) made in correspondence of the jacket 9 lateral wall and configured for supplying, according to a known rule, the opposite chambers of the double-acting cylinder. As it will be better described in the following, the tamping machine 1 comprises at least one power supply (not illustrated), particularly a generator defined by a pump-motor group, which is configured for pressurizing a fluid (oil) and delivering it—via a distributing circuit—to first hydraulic control means 16: these are configured for selectively supplying the double-acting cylinder of the first section 5—via the through conduits of the jacket 9—and for moving the tamping hammer 3 from the working condition to the receiving or exclusion one, and vice versa.

As it is visible from Figures from 5 to 7, for example, further the first section 5 comprises an anchoring portion 13 extending as an axial extension of the jacket 9 from a part opposite to the first end 9*a*. Particularly, the anchoring portion 13 represents a projection emerging from the second end 9*b* of the jacket 9 away from the first end 9*a*. In a preferred but non limiting embodiment of the invention, the anchoring portion 13 is joined in one piece to the jacket 9 of the first portion 5 to define a solid body. The anchoring portion 13, as it will be better described in the following, extends towards and is engaged with the second section 6 of the actuator 4.

De facto, the anchoring portion 13 comprises, in a non limiting way, a circular cross-section tubular body opened at an end opposite to the second end 9*b* of the jacket 9. Specifically, in a non limiting embodiment of the invention, the anchoring portion 13 comprises a cylindrical tubular body joined in one piece to the jacket 9 and having substantially the same shape as this latter (which has also a cylindrical shape). It should be understood the anchoring portion 13 can comprise a projection having any shape and size adapted to enable to engage the jacket 9 of the first section 5 with the second section 6.

As hereinbefore discussed, each actuator 4 further comprises a second section 6 dedicated to enable the hammer 3 to vibrate. As it is visible in the accompanying figures, the second section 6 is engaged and axially aligned with the first section 5: particularly, the sections 5, 6 are longitudinally aligned and axially movable one in relation to the other. In other words, the first and second sections 5, 6 of each actuators are mechanically serially connected to each other.

Also the second section 6 comprises a hydraulic double-acting cylinder exhibiting at least one jacket 7, particularly having a cylindrical shape, extending between the first and second longitudinal ends 7*a*, 7*b* axially delimiting the cylinder: the jackets 9, 7 of the respective first and second sections 5, 6 are axially aligned to each other. As it is visible in FIGS. 5 to 8 for example, the second longitudinal end 7*b* of the jacket 7 of the second section 6 faces the second longitudinal end 9*b* of the jacket 9 of the first section 5: the second ends 7*b*, 9*b* of the jackets 7, 9 of the respective sections 5, 6 are relatively movable by approaching and moving away, particularly axially, from each other.

As it is visible in FIG. 2 for example, the jacket 7 is tightly closed both at the first and second ends. Particularly, the jacket 7, at said first and second longitudinal ends 7*a*, 7*b*, comprises respective fluid-tight blind plugs, particularly devoid of passage openings. Specifically, in the embodiment illustrated in the attached figures, the jacket 7 comprises a tubular through central body, to the longitudinal ends thereof respective blind plugs adapted to close the longitudinal openings are fixed. The jacket 7 exhibits inside an axial sliding wall for a piston 8: the inner lateral part of the jacket 7 is, in a non limiting way, cylindrical and the associated piston 8 being countershaped to said inner lateral wall. The piston 8 will be more specifically described in the following.

As it is visible in FIGS. 5 to 8 for example, the jacket 7 of the second section 6 comprises at least one longitudinal through groove 12 placed on a lateral wall of said jacket 7 between the first and second longitudinal ends 7*a*, 7*b* thereof. The groove 12 essentially comprises a pocket developing along the prevalent development direction of the jacket 7 and, particularly, along the axial sliding direction of the piston 8. In a non limiting way, the groove 12 is placed at a centre line of the jacket 7 and exhibits a rectangular shape. In a preferred but non limiting embodiment of the invention, the jacket 7 comprises two grooves 12 opposite to each other with respect to the jacket 7 itself. Particularly, the grooves 12 are placed symmetrically with respect to the jacket 7 around a longitudinal symmetry axis of the same. Each groove 12 defines substantially a lateral opening of the jacket 7.

Figure 5:
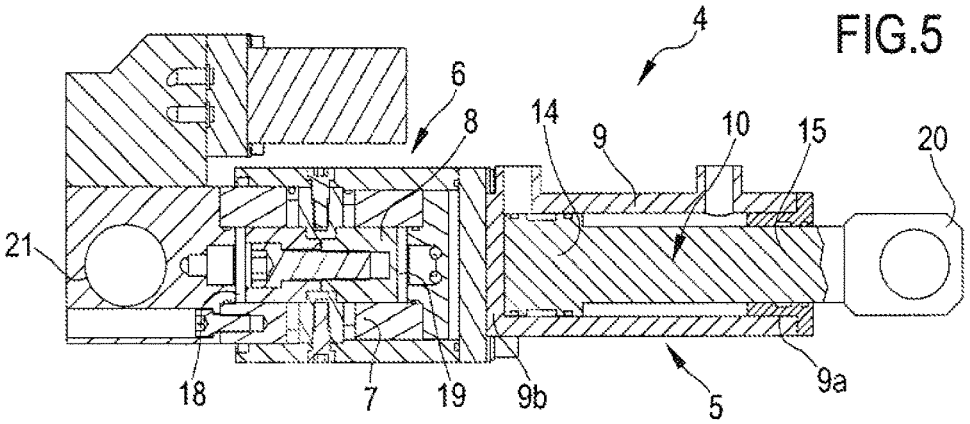
FIGS. 5 to 7 are respective longitudinal cross-section views of an actuator, a tamping machine according to the present invention, placed in three different operative conditions.
Figure 6:
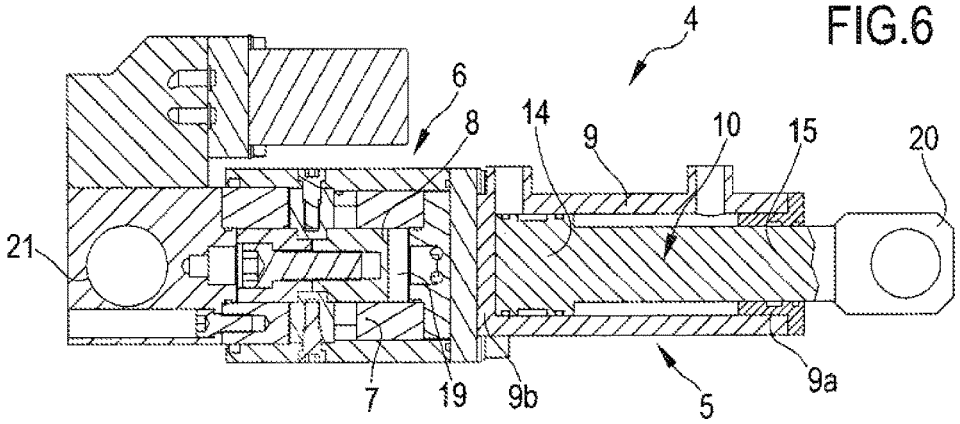
Figure 7:
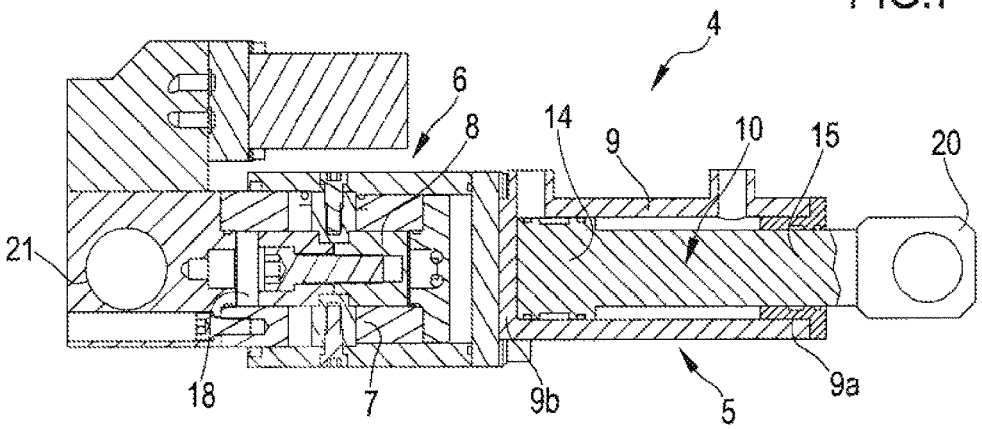

Moreover, as it is visible from the cross-section views of FIGS. 5 to 7 for example, the second section 6 comprises a respective constraining element 21 configured for being associated to the frame 2 or thrusting portion 3*b* of the hammer 3. The attached figures illustrate a preferred but non limiting arrangement of the invention, wherein the constraining element 21 is directly associated to the machine 1 frame 2 opposite to the constraining portion 20 of the first section 5 which is directly constrained to the thrusting portion 3*b*. Advantageously, the constraining element 21 can comprise a sleeve or pin adapted to cooperate with a respective pin or sleeve of the frame 2 to define a hinge-type constrain. Alternatively, the constraining element 21 and frame 2 can comprise a mechanical joint which is again adapted to define a hinge-type constrain.

In the accompanying figures, the constraining portion 21 is joined in one piece to the first end 7*a* of the jacket 7; particularly it forms an solid piece with the closing plug of the cylinder, fixed at the first end 7*a* of the jacket 7. De facto, in the machine 1 object of the present invention, it is just the jacket 7 of the second section 6 to be engaged, particularly directly, with the frame 2 or thrusting portion 3*b* of the tamping hammer 3. The attached figures illustrate a preferred but non limiting embodiment of the invention wherein the jacket 7 is constrained and fixed to the frame 2.

Figure 8:
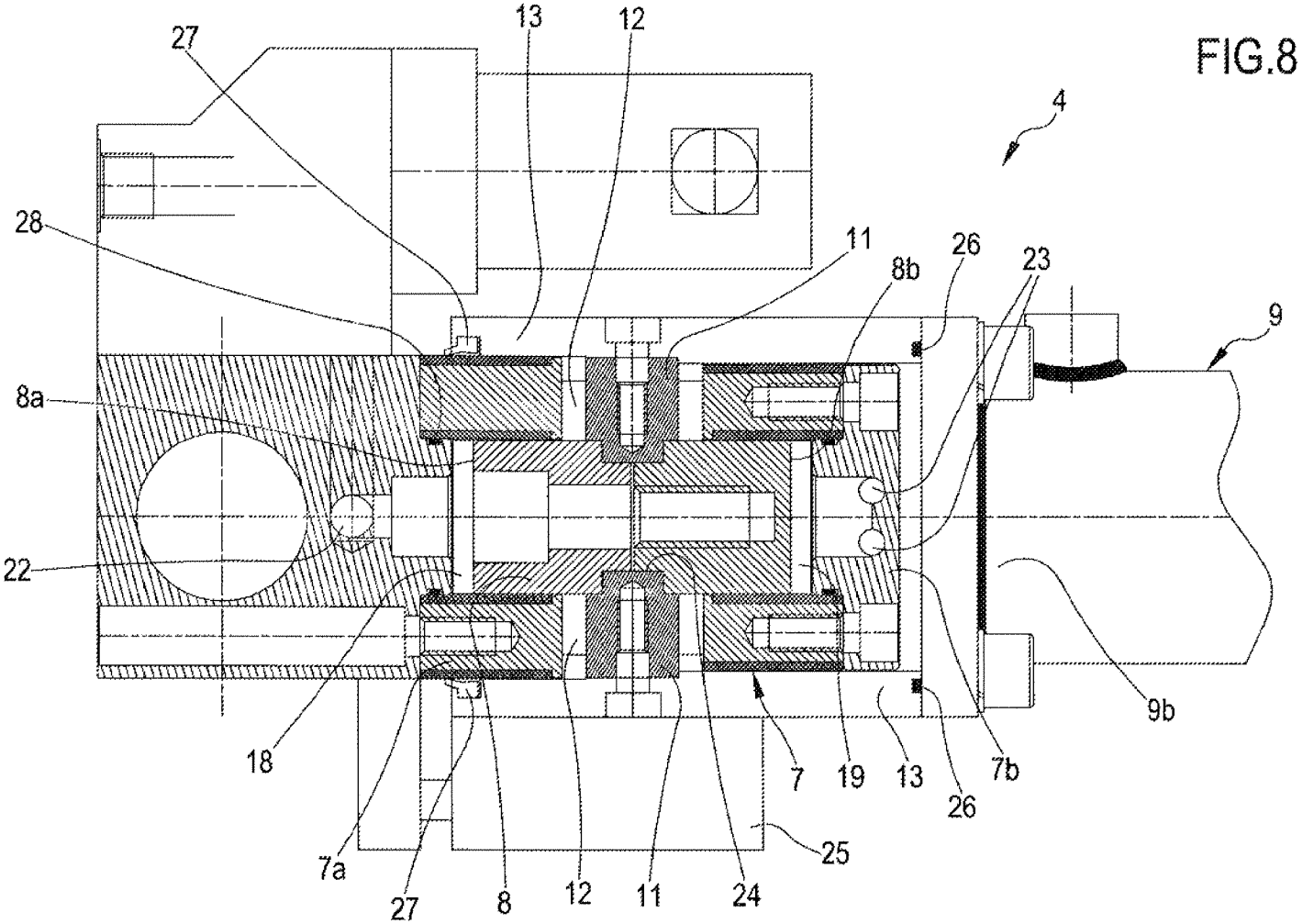
FIG. 8 is a longitudinal cross-section of a further actuator of a tamping machine according to the present invention.

As it is visible in FIG. 8, further the cylinder of the second section 6 comprises at least one first and one second through supply conduits 22, 23 made at a lateral wall of the jacket 7 and configured for supplying opposite chambers of the double-acting cylinder. As it will be better described in the following, the tamping machine 1 comprises at least one power supply (not illustrated), particularly a power supply defined by a pump-motor group configured for pressurizing a fluid (oil) and delivering—via a distributing circuit—to first hydraulic control means 17: these are configured for selectively supplying the double-acting cylinder of the second section 6—via the through conduits 22 and 23 of the jacket 7—and enabling the oscillation, and therefore the vibration of the tamping hammer 3 around the engagement portion 3*c*.

From the dimensional point of view, the jacket 7 exhibits an overall axial extension, substantially defined by the distance between the first and second longitudinal ends 7*a*, 7*b*, comprised between 150 and 200 mm. However, the inner sliding lateral wall of the jacket 7 exhibits an axial extension comprised between 160 and 190 mm. Still referring to the jacket 7 of the second section 6 from the dimensional point of view, this latter exhibits, in a non limiting way, a passage cross-section smaller than the passage cross-section of the jacket 9; specifically, the passage cross-section area of the jacket 7 of the second section 6 is comprised between 5 and 200 cm2, still more particularly between 20 and 100 cm2, still more particularly between 50 and 100 cm2. The cross-section passage area means the passage cross-section of the piston 8 defined by the inner lateral sliding wall of the jacket 7.

As hereinbefore described, the second section 6 comprises at least one piston 8 slidingly moveable inside the jacket 7 along a prevalent development axis of the same: the piston 8 is axially movable with respect to the jacket 7. As hereinbefore described, the jacket 7 is closed at the first and second longitudinal ends 7*a*, 7*b*: the piston 8 exhibits an overall axial size defined by respective opposite thrusting faces of the piston 8 itself which is entirely received inside the jacket 7.

De facto, the piston 8 of the second section 6 comprises only a head completely received in the jacket 7: the piston 8 is devoid of a stem and does not exhibit parts projecting from the longitudinal ends of the jacket 7. In other words, the piston 8 exhibits an overall axial extension defined by the distance between a first and second longitudinal ends 8*a*, 8*b* at which the thrusting faces of the piston 8 itself are defined: the first end of the piston 8 is inside the jacket 7 and faces the first closed end 7*a* of this latter, while the second end 8*b* of the piston 8 is inside the jacket 7 and faces the second closed end 7*b* of the jacket 7. As it is for example visible in FIG. 8, the faces of the first and second ends 8*a*, 8*b* of the piston 8 define cooperatively with the inner lateral wall and respective ends 7*a*, 7*b* of the jacket 7 of the second section 6, respective chambers 18, 19. Specifically, the inner lateral wall, first end (plug) 7*a* and first thrusting face (at the first end 8*a*) of the piston 8 define the first chamber 18, while the inner lateral wall, second end (plug) 7*b* and second thrusting face (at the second end 8*b*) of the piston 8 define the second chamber 19.

Each chamber exhibits a volume variable as a function of the relative position taken by the piston 8 of the second section 6 with respect to the jacket 7 of this latter section. It is to be noted, due to the absence of the stem of the piston, the maximum value, particularly both the maximum value and the minimum value, definable by each of said chambers, is substantially identical. As illustrated in FIG. 8, the first chamber 18 is fluidically communicating with the first conduit 22, while the second chamber 19 is fluidically communicating with the second chamber 23; the selective introduction of working fluids (oil) in the respective chambers enables to alternatively move the piston 8 inside the jacket 7 and consequently to vibrate the hammer 3.

Moreover, it is noted that the structure and size of the piston 8 of the second section 6, enable at the same piston 8 to operate inside the jacket 7 without using seals: there are no seals between the jacket 7 and the piston 8 of the second section 6.

More particularly, as it is visible in the accompanying figures, the piston 8 of the second section 6 comprises a cylindrical body longitudinally delimited by the thrusting faces of the first and second ends 8*a*, 8*b*; at a lateral wall, the piston comprises an engagement portion 24 configured for stably receiving a connecting element 11 fixed with respect to the piston 8 and emerging transversally with respect to this latter.

The connecting element 11 of the piston 8 is axially slidingly engaged inside at least one longitudinal groove 12 of the jacket 7. Particularly, the connecting element 11 comprises a plate fixed to the piston 8 and emerging normal to the lateral wall of this latter: the plate defines a kind of mechanical stop configured for axially slidingly being engaged inside the groove 12. The connecting element 11, during the movement of the piston in relation to the jacket 7, slides inside the groove 12 and defines a kind of stop for the piston 8. The attached figures illustrate a preferred but non limiting arrangement of the invention, wherein the jacket 7 comprises two grooves 12 and a connecting element 11 emerging from opposite sides of the piston 8 and configured for being slidingly engaged inside the two grooves 12.

Preferably, the connecting element 11 is fixed via mechanical members, for example screws, at the center line of the piston 8: in this way, the mechanical stop defined by the connecting element 11 is engaged in a balanced way with the piston 8 and prevents an undesired development of stresses when sliding on the same.

The connecting element 11, besides defining a kind of stop, is configured for being stably engaged with the anchoring portion 13 of the first section 5; as it is visible in the attached figures, the anchoring portion 13 extends around the jacket 7 of the second section 6 to above the groove 12 (to the two grooves 12) and engages the connecting element 11. De facto, the jacket 9 of the first section 5 is joined to the piston 8 of the second section 6 by the connecting element 11: the piston 8 is therefore moveable along a same axis, with the connecting element 11 and jacket 9.

In a preferred but non limiting embodiment of the invention, the anchoring portion 13 of the first section 5 extends at least partially around the jacket 7 of the second section 6 and engages the connecting portion 11 at opposite sides of said jacket 7: the anchoring portion 13 comprises substantially a tubular jacket at least partially outwardly covering the jacket 7 of the second section 6 to the grooves 12 and engaging the connecting element 11.

From the dimensional point of view, the opposite longitudinal thrusting faces of the piston (ends 8*a*, 8*b*) substantially exhibit the same thrusting surface, particularly the thrusting surface of both the faces is comprised between 5 and 200 cm2, more particularly between 20 and 100 cm2, still more particularly between 50 and 100 cm2. As hereinbefore described, the second section 6 is dedicated to the vibration of the hammer 3; for this purpose, the piston 8 of the second section 6 exhibits a maximum axial stroke smaller than the piston 10 axial stroke. Specifically, the ratio of the maximum axial stroke of the piston 10 of the first section 5 to the maximum axial stroke of the piston 8 of the second section 6 is greater than 2, particularly is comprised between 4 and 10. Quantitatively, the maximum axial stroke of the piston 8 of the second section is comprised between 5 and 30 mm, particularly between 10 and 25 mm.

The cross-section of the jacket 7 and the stroke of the piston 8 define the maximum and minimum volumes of each chamber 18 and 19. The maximum volume definable by each chamber 18, 19 is comprised between 20 and 100 cm3, particularly between 20 and 70, still more particularly is comprised between 25 and 35 cm3, while the minimum value definable by the same is comprised between 0 and 20 cm3, particularly is comprised between 0 and 10 cm3.

As it is visible in FIG. 8 for example, each actuator 4 can advantageously comprise at least one transducer 25, engaged from one side, with the first section 5—particularly with the anchoring portion 13 of the first section—and on the other side with the jacket 7 of the second section 6; the transducer 25 is configured for generating a signal in relation to at least the movement and force developed by the same actuator 4. Further, the machine can comprise at least one control unit (not illustrated) connected to the transducer 25 and configured for receiving the signal from this latter and monitoring at least one the following conditions of the actuator: position of the tamping hammer 3 in relation to the frame 2 or in relation to the another hammer 3, vibration frequency of the actuator, force developed by the actuator and therefore the stress for tamping the ballast.

Then, the control unit can be connected to the power supply of the actuator 4 and hydraulic control means 16 and 17; the control unit is configured for managing the operation of the power supply and hydraulic control means 16, 17 for managing and controlling the movement and operation of the first and second sections 5, 6 of each actuator 4.

Advantageously but without limitation, each actuator 4 could comprise seals 26, 27 (FIG. 8) interposed between the anchoring portion 13 of the first section and the jacket 7 of the second section 6: without the seals on the piston 8 it is possible to provide sealing gaskets outside the jacket 7 of the second section. Moreover, in case the jacket 7 of the second section 6 exhibits, at the second end 7*a*, a plug closing the jacket 7 itself, moreover the actuator 4 could provide a further seal 28 interposed between said plug and the jacket 7 (FIG. 8).

As hereinbefore described, the machine 1 comprises power supplies and hydraulic control means 16, 17 for the first and second sections 5 and 6. The first section 5, as hereinbefore described, is extendable and is configured for moving the respective tamping hammer 3 from a substantially vertical working position (the condition illustrated in FIG. 2, for example) to a receiving or exclusion position. The second section 6 vibrates and is adapted to subject the first section 5, and the respective hammer 3 connected to the former, to a cyclical and alternate working vibration whose frequency can be varied as it will be specified in the following. The second vibrating section 6 is mechanically serially placed in relation to the first section 5, because the jacket 9 thereof is rigidly connected to the piston 8 of the second section 6 (this connection is made by the connecting element 11).

The sections 5 and 6 of each actuator 4 are distinctly supplied by hydraulic circuits connected to the cited power supply (for example a single motor-pump group); the first section 5 is extendable by a respective supply-discharge commutator drivable by the operator in order to enable to exclude one or more actuators 4 of each machine 1 when required by the track trajectory; the second section 6 by the supply-discharge commutators driven according to a cyclical sequence by one or more distributing means 17.

Figure 9:
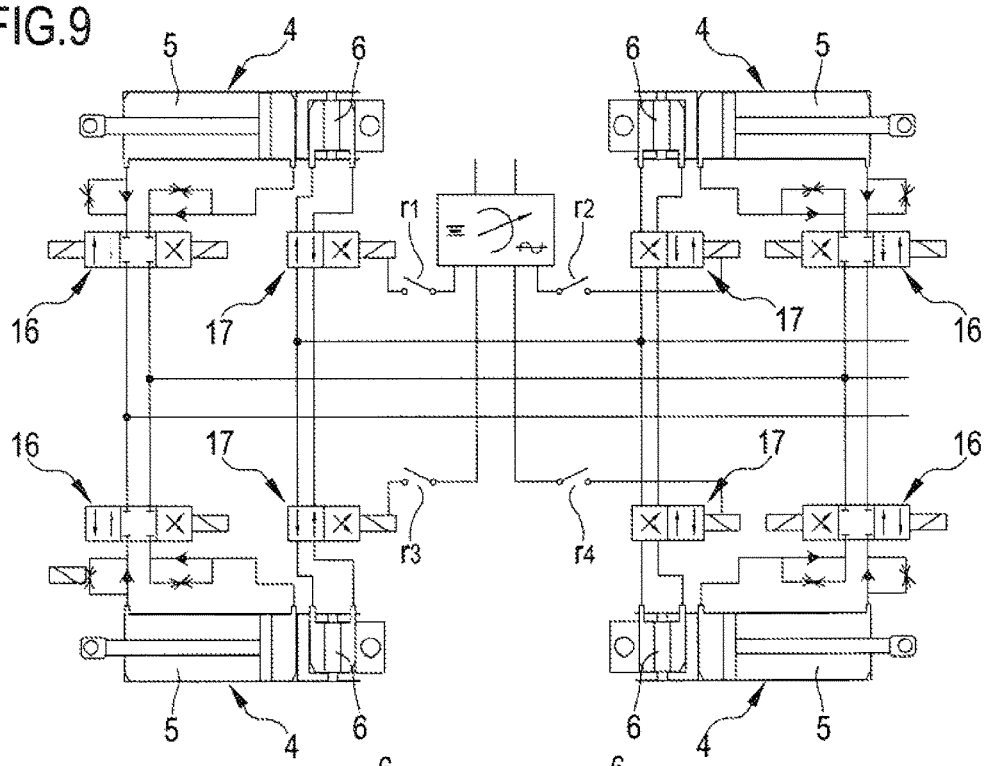
FIGS. 9 to 12 are respective supply diagrams of the actuators of a tamping machine according to the present invention.

The diagram of FIG. 9 shows a hydraulic circuit adapted to this purpose. According to such diagram, the first section 5 of each actuator is supplied by the motor-pump generator group via switching solenoid valves having blocking intermediate positions whose solenoids are subjected to respective selectively energizing commands, for example lever drives, placed in the control cab. This enables the operator to command the extension or retraction of the extendable section of each actuator and, consequently, to lower to a working position or to exclude each hammer 3 of the tamping machine 1 in the operative position. According to the position of the tamping machine 1, the same is useable for straight-track or points works, further enables, in the points position, to selectively operate with one or two pairs of hammers 3 for each machine 1, and also, if required, with a single hammer 3, this provides the car 100 itself with a flexibility of use and an operativity speed that until now are still unmatched.

In the blocking intermediate position, shown in the figure, the solenoid valves intercept all the conduits (they are definable as supply or discharge conduits based on the position of the solenoid valve) of the corresponding section of the actuator 4 making in this way the piston and jacket of the same cross-section reciprocally integral to each other.

The second section 6 of each actuator 4 is supplied, via respective switching two-way type solenoid valves without a blocking position and the solenoids of said solenoid valves are cyclically supplied by a variable frequency oscillator, preferably of the electronic type. As clearly shown in FIG. 9, between the solenoids of the valves and the supply oscillator there are contacts r1-r2-r3-r4 of corresponding exclusion relays connected to the switching solenoid valves and which are opened for stopping supplying said second section 6 of each actuator when the corresponding first section 5 is extended for raising the respective tamping hammer 3 to the exclusion position.

Figure 10:
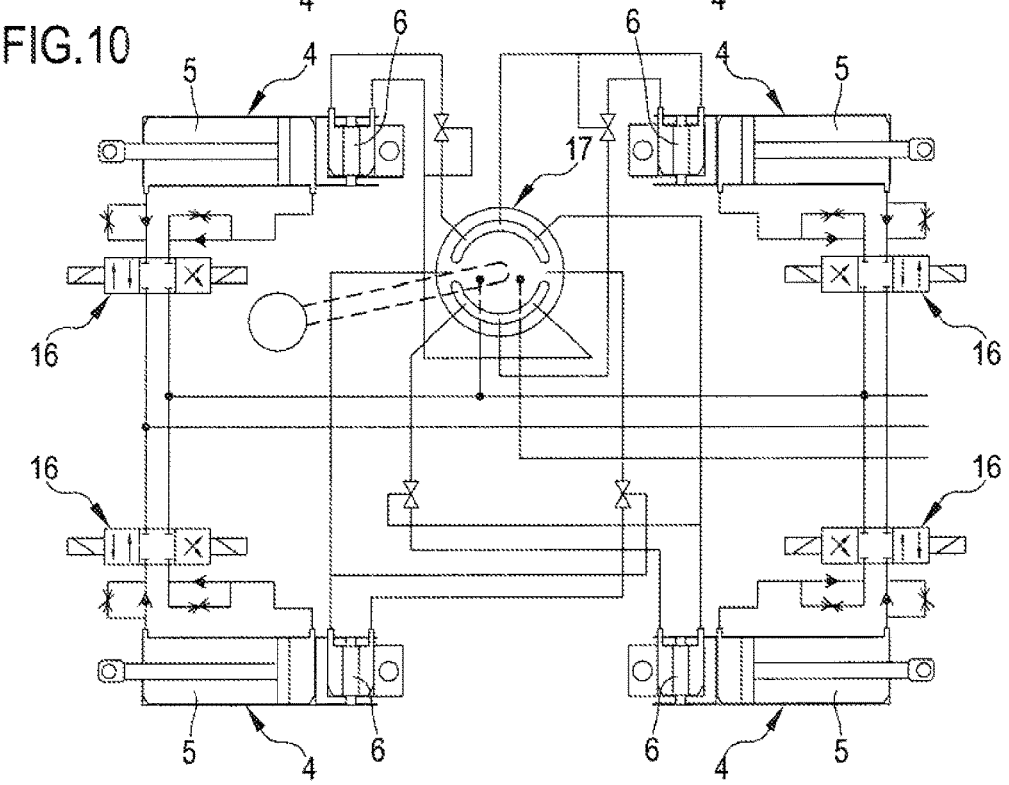

The circuit illustrated in FIG. 10, differs from the one in FIG. 9 in that the switching solenoid valves are substituted with a rotating mechanical commutator driven by a variable speed electric motor. In this case, "bypass" solenoid valves which are also connected to the solenoid valves for the above described exclusion operation, are provided.

Figure 11:
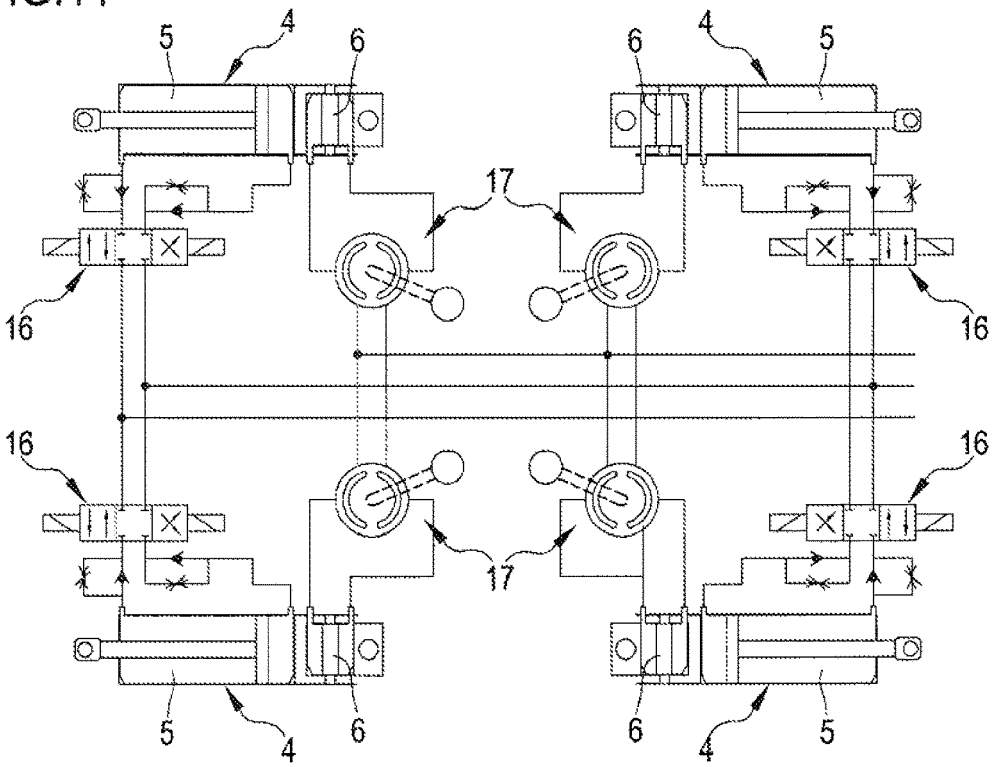

In the variant in FIG. 11, the second vibrating section 6 of each actuator is supplied by its own rotating commutator driven by a respective motor according to an arrangement avoiding the connection of the "bypass" valves and enabling to vary independently the operative frequency of each hammer 3.

Figure 12:
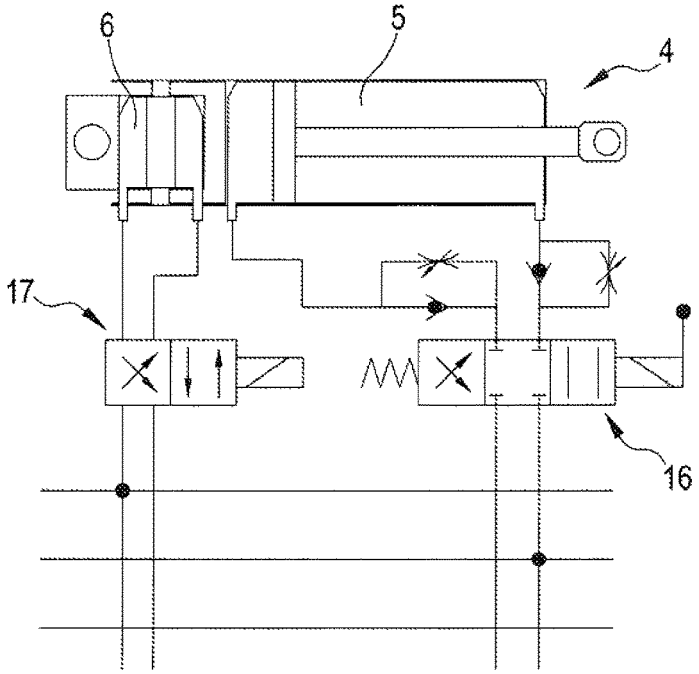

The variant in FIG. 12 differs from what was beforehand described because the switching solenoid valves are substituted by manual command-type switching boxes. Obviously, provided the validity of the invention, the manufacturing features and embodiments could be widely changed, with respect to what has been described and illustrated as a non limiting example, without falling out from the scope of the invention.

Railway Car

Moreover, the invention refers to a railway car 100 provided with a supporting structure 101 exhibiting at least four wheels configured for enabling the abutment and the engagement of the car on a track: the supporting structure substantially defines cars abutting on rails. The car 100 comprises at least one tamping machine 1 (advantageously there are a plurality of tamping machines 1, for example from 2 to 4, for each car 100) engaged with the supporting structure 101 so that the same machine 1 is interposed between the track and structure 101.

Each tamping machine 1 is engaged with the supporting structure 101 so that a pair of hammers 3 are placed above a track at at least one sleeper T of the ballast (see FIG. 1, for example). In the working condition of the tamping machine, the pair of hammers 3 are configured for surrounding at least partially a sleeper T for tamping it.

In detail, the frame 2 of the tamping machine 1 is movably constrained to the supporting structure 101: the frame 2 is configured for translating from a raised position wherein the frame 2 itself is placed in proximity of the structure 101 to a lowered position wherein the frame 2 itself is more spaced from the structure 101 than from the retracted position, and vice versa.

Advantageously, the railway car 100 comprises at least one hydraulic cylinder 102 (FIGS. 1 and 3) engaged, on one side, with the supporting structure 101 and, on the other side, with the frame 2: the hydraulic cylinder is configured for moving the frame 2 at least between the raised position and the lowered position, and vice versa.

The hammers 3 of the tamping machine 1, arranged in the working condition, are configured for being spaced from the railway ballast M when the frame 2 is in the raised position (FIG. 1); in the raised condition of the machine 1, the hammers are far from the ballast for enabling the car 100 to move along the tracks (movement of the car 100).

The hammers 3 of the tamping machine 1, arranged in the working condition, are configured for sinking at least partially into the railway ballast when the frame 2 is in the lowered position (FIG. 2). In the lowered position, the hammers are arranged inside the ballast and operate for tamping the sleepers T of this latter; in such arrangement, the car 100 is prevented from moving along the rails.

Under the condition wherein the car is provided with a plurality of tamping machines 1, it is possible to connect the same machines to a control unit (not illustrated in the accompanying figures) configured for commanding independently the raised or lowered condition of each machine 1 or for coordinating the movement of all the machines. Advantageously, the control unit is connected to the hydraulic cylinders 102 of each machine 1 and, at the same time, to all the actuators of these latter.

Therefore, the control unit is configured for managing both the translation of each single machine 1 and the working and tilting conditions of each single hammer 3.

Further, the car 100 control unit can be connected to the transducers 25 of the actuators 4 for detecting at least one of the following parameters: the position of the tamping hammer 3 in relation to the frame 2 or in relation to another hammer 3, the vibration frequency of the actuator, the force exerted by the actuator and therefore the force for tamping the ballast M.

Based on the signal received by the transducer 25, the control unit can measure the force exerted by the hammer 3 and the counteracting force of the ballast during the tamping operations; this parameter is useful for evaluating the state of the ballast M. De facto, the control unit, by the transducers 25, is capable of effectively monitoring the actuators directly operating for tamping the ballast; by the signals received by the transducers 25 (the force exerted by the actuators and the counteracting force of the ballast), the control unit is configured for verifying the soundness of the railway ballast M and possibly signaling a fail in case the condition of this latter does not fall inside desired parameters.

Advantageously, the car 100 can comprise a power supply group (not shown) consisting of a diesel engine and one or more hydraulic pumps with associated fuel and hydraulic fluid tanks; the power supply group can be housed in a hood adjacent to the control cab and can be configured for supplying one or more machines 1 (the power supply can supply both the cylinders 102 and actuators 4).

Moreover, the control unit can be connected to the power supply both of the cylinder 102 and actuators 4 so that the same can coordinate the raised and lowered condition of the tamping machine 1 with the lowered (operative) and receiving or exclusion conditions of the hammers 3.

Advantageously, the control unit can be connected to the hydraulic control means 16 and 17 of each tamping machine for driving the solenoid valves and then managing the sections 5 and 6 of each actuator.

ADVANTAGES OF THE INVENTION

The present invention enables to solve the described limitations and drawbacks of the prior art and enables to obtain remarkable advantages. Particularly, the tamping machine 1 object of the present invention exhibits a certainly simplified and compact structure enabling to easily mount it on the car 100 and a straightforward maintenance. De facto, the particular structure of each actuator 4 enables to provide extremely compact cylinders both longitudinally and transversally. This makes the machine 1 extremely compact, this characteristic enabling to certainly improve the stability and strength of the same. The high stability of the machine enables the same to operate under high frequencies (the hammers 3 can operate at high frequencies) and variable inside a wide range of values selectable in relation to the state of the ballast to be regenerated: the structure of the machine 1 avoids the generation of unacceptable structural stresses on behalf of a substantial increase of the performance thereof.

Moreover, reducing the size of the tamping machine 1, object of the present invention, enables to fit several tamping hammers 3 on each machine 1 so that, if required, this latter can simultaneously operate on consecutive sleepers of a track. De facto, the possibility of fitting on the same side of the car 100 a plurality of machines and therefore of tamping hammers 3, enables to simultaneously regenerate plural sleepers T. Further, it is noted that the possibility of rapidly excluding one or more hammers 3 from the tamping machine 1, makes its use extremely flexible: the possibility of using the first section 5 for excluding a hammer 3 enables to use the machine both on straight-tracks and points of a track. An important advantage of the invention is given by the particular structure of the actuators 4; particularly, the structure of the piston 8 of the second section 6 ensures a substantial efficiency: the absence of a stem enables the piston to exploit, on both the piston 8 faces, a common large thrusting surface. The fact that the piston 9 can completely remain received in the jacket 7 and that it can generate on the opposite faces the same force, enables to define an extremely compact and balanced double-acting cylinder. The absence of the stem enables to reduce the transversal size of the piston 8 and consequently of all the second section 6. The force exerted by the second section 6 (the vibrating section) is capable of vibrating each hammer at high frequencies and simultaneously exerting a high movement force: each hammer 3 is capable of suitably regenerating the ballast also by means of small powers.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A tamping machine comprising:

at least one supporting frame associable above at least one railway track, said railway track being of a type comprising at least two rails and a plurality of sleepers, at least one tamping hammer extending along a prevalent development direction between an operative portion and a thrusting portion, the tamping hammer comprising an engaging portion, interposed between the operative portion and the thrusting portion, pivoted to the frame and suitable for enabling the hammer to rotate with respect to the frame, the tamping hammer being configured for being arranged in a working condition wherein the hammer is beside a track between a sleeper and an immediately following one along the track, the hammer, in the working condition, being configured for being transversally arranged to the rails and to the sleepers, with an operative portion facing said ballast, the tamping hammer being further configured for being arranged at least in an exclusion or receiving condition wherein the hammer is substantially positioned horizontally or in a sloped position with respect to the working position suitable for defining a starting position for tamping the sleeper, at least a hydraulic actuator engaged, on a side, with the thrusting portion of the tamping hammer and, on the other side, with an abutment portion, the actuator comprising at least one first and one second sections axially aligned and engaged with each other, one of said first and second sections being engaged with the abutment portion while the other being engaged with the thrusting portion of the tamping hammer, the first section being extendable and configured for moving the hammer at least between the working condition and the receiving or exclusion condition, and vice versa, the second section being configured for being powered by distributing means having cyclic alternating functioning for enabling the tamping hammer to vibrate, the second section comprising at least one jacket extending between a first and second longitudinal ends and at least one piston slidingly moveable inside the jacket, wherein the jacket is closed at the first and second longitudinal ends, the piston having an overall axial size defined by respective opposite thrusting faces of the piston itself, which is entirely contained inside the jacket, wherein the second section comprises at least one connecting element stably constrained to and transversally emerging from the piston of the second section itself, the jacket of the second section comprising at least one longitudinal through groove arranged on a lateral wall of said jacket between the first and second longitudinal ends of the same, the connecting element of the piston passing through and being slidingly axially engaged inside the longitudinal groove, and wherein the jacket of the first section comprises at least one anchoring portion engaged with the connecting element of the second section, the jacket of the first section being, with the piston and connecting element of the second section, relatively movable with respect to the jacket of said second section.

2. The machine according to claim 1, wherein the jacket of the second section is engaged with the frame or the thrusting portion of the tamping hammer.

3. The machine according to claim 1, wherein the jacket, at said first and second longitudinal ends, comprises respective fluid-tight blind plugs, the piston being entirely contained in the jacket and entirely interposed between said blind plugs.

4. The machine according to claim 1, wherein the piston comprises only a head entirely contained in the jacket.

5. The machine according to claim 1, wherein the piston is devoid of a stem and does not exhibit parts projecting from the longitudinal ends of the jacket.

6. The machine according to claim 1, wherein the fixing portion extends as an axial continuation of the jacket of the first section outside the jacket of the second section.

7. The machine according to claim 1, wherein the fixing portion extending parallelly to a longitudinal development direction of the jacket of the second section.

8. The machine according to claim 1, wherein the piston of the second section comprises a cylindrical body longitudinally delimited by the respective faces of the of the first and seconds ends of the same piston which define the respective thrusting faces of this latter, the opposite thrusting faces of the piston of the second section exhibiting substantially the same thrusting surface.

9. The machine according to claim 1, wherein the faces of the first and second ends of the piston define, cooperatively with the inner lateral wall and respective ends of the jackets of the second section, respective chambers, each said respective chamber exhibits a varying volume according to the relative position taken by the piston of the second section in relation to the jacket of this latter section, the maximum volume definable by each of said chambers is substantially equal.

10. The machine according to claim 1 further comprising:

at least one power supply, first hydraulic control means connected to the power supply and configured for selectively distributing the fluid to the first section for enabling the displacement of the tamping hammer from the working condition to the receiving or exclusion one, and vice versa; and wherein the machine comprises:

at least one power supply, second hydraulic control means connected to the power supply and configured for selectively supplying the second section and enabling the tamping hammer to oscillate and therefore vibrate around the engaging portion.

11. The tamping machine according to claim 10, wherein the power supply is a generator defined by a pump-motor assembly.

12. The machine according to claim 1, wherein the first hydraulic control means are configured for excluding the second hydraulic control means, and therefore the supply of the second section, in the receiving or exclusion condition of the tamping hammer.

13. The machine according to claim 1, comprising at least two tamping hammers facing each other and configured for being positioned at a predetermined distance measured along the tracks extension, each tamping hammer tamping being configured for moving between the working position and the receiving or exclusion position.

14. The machine according to claim 1, wherein the pair of tamping hammers are connected and moved by a single actuator which has the first section engaged with a hammer thrusting portion, and the second section connected to the other tamping hammer; or said machine comprises at least two hydraulic actuators, each dedicated to move a tamping hammer of said pair of hammers, each of said actuators being engaged, on a side, with the frame and, on the other side, with the thrusting portion of a tamping hammer, one of said first and second sections of each actuator being engaged with the frame while the other being engaged with the thrusting portion of the tamping hammer.

15. The machine according to claim 1, comprising at least one transducer engaged on the actuator and configured generating a signal regarding at least the movement and the force expressed by the same actuator, and wherein the machine comprises at least one control unit connected to the transducer and configured for receiving the signal from the latter and monitoring at least one of the following actuator conditions:

the position of the tamping hammer with respect to the frame or with respect to another hammer, the vibration speed of the actuator, the force imposed by the actuator and therefore the strain for tamping the ballast, wherein the control unit is connected to the power supply of the actuator and to the hydraulic control means, the control unit being configured for managing the operation of the power supply and of the control hydraulic means for managing and controlling the movement and operation of the first and second sections of the actuator.

16. The machine according to claim 1, wherein the jacket, at said first and second longitudinal ends, comprises respective fluid-tight blind plugs, the piston being entirely contained in the jacket and entirely interposed between said blind plugs, and wherein the piston is devoid of a stem and does not exhibit parts projecting from the longitudinal ends of the jacket.

17. The machine according to claim 1, wherein the first section comprises at least one jacket extending between a first and second longitudinal ends and at least one piston slidingly movable inside said jacket, the jacket of the first section being engaged with the piston of the second section and being movable with respect to the jacket of said second section, and wherein the piston comprises only a head entirely contained in the jacket.

18. The machine according to claim 1, wherein the piston is devoid of a stem and does not exhibit parts projecting from the longitudinal ends of the jacket, and wherein the piston of the second section comprises a cylindrical body longitudinally delimited by the respective faces of the of the first and seconds ends of the same piston which define the respective thrusting faces of this latter, the opposite thrusting faces of the piston of the second section exhibiting substantially the same thrusting surface.

19. The machine according to claim 1, wherein the jacket of the second section is directly engaged with the frame or the thrusting portion of the tamping hammer.

20. The machine according to claim 1, wherein the first section comprises at least one jacket extending between a first and second longitudinal ends and at least one piston slidingly movable inside said jacket, the jacket of the first section being engaged with the piston of the second section and being movable with respect to the jacket of said second section.

21. The machine according to claim 1, wherein the second section comprises at least one connecting element stably constrained to and transversally emerging from the piston of the second section itself, the jacket of the second section comprising at least one longitudinal through groove arranged on a lateral wall of said jacket between the first and second longitudinal ends of the same, the connecting element of the piston passing through and being slidingly axially engaged inside the longitudinal groove, and wherein the jacket of the first section comprises at least one anchoring portion engaged with the connecting element of the second section, the jacket of the first section being, with the piston and connecting element of the second section, relatively movable with respect to the jacket of said second section.

22. The tamping machine according to claim 1, wherein the hammer, in the working condition, is configured for being arranged vertically to the ballast.

23. A tamping machine comprising:

at least one supporting frame associable above at least one railway track, said railway track being of a type comprising at least two rails and a plurality of sleepers, at least one tamping hammer extending along a prevalent development direction between an operative portion and a thrusting portion, the tamping hammer comprising an engaging portion, interposed between the operative portion and the thrusting portion, pivoted to the frame and suitable for enabling the hammer to rotate with respect to the frame, the tamping hammer being configured for being arranged in a working condition wherein the hammer is beside a track between a sleeper and an immediately following one along the track, the hammer, in the working condition, being configured for being transversally arranged to the rails and to the sleepers, with an operative portion facing said ballast, the tamping hammer being further configured for being arranged at least in an exclusion or receiving condition wherein the hammer is substantially positioned horizontally or in a sloped position with respect to the working position suitable for defining a starting position for tamping the sleeper, at least a hydraulic actuator engaged, on a side, with the thrusting portion of the tamping hammer and, on the other side, with an abutment portion, the actuator comprising at least one first and one second sections axially aligned and engaged with each other, one of said first and second sections being engaged with the abutment portion while the other being engaged with the thrusting portion of the tamping hammer, the first section being extendable and configured for moving the hammer at least between the working condition and the receiving or exclusion condition, and vice versa, the second section being configured for being powered by distributing means having cyclic alternating functioning for enabling the tamping hammer to vibrate, the second section comprising at least one jacket extending between a first and second longitudinal ends and at least one piston slidingly moveable inside the jacket, wherein the jacket is closed at the first and second longitudinal ends, the piston having an overall axial size defined by respective opposite thrusting faces of the piston itself, which is entirely contained inside the jacket, wherein the first section comprises at least one jacket extending between a first and second longitudinal ends and at least one piston slidingly movable inside said jacket, the jacket of the first section being engaged with the piston of the second section and being movable with respect to the jacket of said second section.

24. The tamping machine according to claim 23, wherein the piston comprises only a head entirely contained in the jacket, the piston is devoid of a stem and does not exhibit parts projecting from the longitudinal ends of the jacket.

25. The tamping machine according to claim 23, wherein the pair of tamping hammers are connected and moved by a single actuator which has the first section engaged with a hammer thrusting portion, and the second section connected to the other tamping hammer; or said machine comprises at least two hydraulic actuators, each dedicated to move a tamping hammer of said pair of hammers, each of said actuators being engaged, on a side, with the frame and, on the other side, with the thrusting portion of a tamping hammer, one of said first and second sections of each actuator being engaged with the frame while the other being engaged with the thrusting portion of the tamping hammer.

26. The tamping machine according to claim 23, comprising at least one transducer engaged on the actuator and configured generating a signal regarding at least the movement and the force expressed by the same actuator, and wherein the machine comprises at least one control unit connected to the transducer and configured for receiving the signal from the latter and monitoring at least one of the following actuator conditions:

the position of the tamping hammer with respect to the frame or with respect to another hammer, the vibration speed of the actuator, the force imposed by the actuator and therefore the strain for tamping the ballast, wherein the control unit is connected to the power supply of the actuator and to the hydraulic control means, the control unit being configured for managing the operation of the power supply and of the control hydraulic means for managing and controlling the movement and operation of the first and second sections of the actuator.

27. The tamping machine according to claim 23, wherein the piston is devoid of a stem and does not exhibit parts projecting from the longitudinal ends of the jacket, and wherein the piston of the second section comprises a cylindrical body longitudinally delimited by the respective faces of the of the first and seconds ends of the same piston which define the respective thrusting faces of this latter, the opposite thrusting faces of the piston of the second section exhibiting substantially the same thrusting surface.

28. The tamping machine according to claim 23, wherein the second section comprises at least one connecting element stably constrained to and transversally emerging from the piston of the second section itself, the jacket of the second section comprising at least one longitudinal through groove arranged on a lateral wall of said jacket between the first and second longitudinal ends of the same, the connecting element of the piston passing through and being slidingly axially engaged inside the longitudinal groove, and wherein the jacket of the first section comprises at least one anchoring portion engaged with the connecting element of the second section, the jacket of the first section being, with the piston and connecting element of the second section, relatively movable with respect to the jacket of said second section.

29. The tamping machine according to claim 23, wherein the jacket, at said first and second longitudinal ends, comprises respective fluid-tight blind plugs, the piston being entirely contained in the jacket and entirely interposed between said blind plugs.

30. A tamping machine, comprising:

at least one supporting frame associable above at least one railway track, said railway track being of a type comprising at least two rails and a plurality of sleepers, at least one tamping hammer extending along a prevalent development direction between an operative portion and a thrusting portion, the tamping hammer comprising an engaging portion, interposed between the operative portion and the thrusting portion, pivoted to the frame and suitable for enabling the hammer to rotate with respect to the frame, the tamping hammer being configured for being arranged in a working condition wherein the hammer is beside a track between a sleeper and an immediately following one along the track, the hammer, in the working condition, being configured for being transversally arranged to the rails and to the sleepers, with an operative portion facing said ballast, the tamping hammer being further configured for being arranged at least in an exclusion or receiving condition wherein the hammer is substantially positioned horizontally or in a sloped position with respect to the working position suitable for defining a starting position for tamping the sleeper, at least a hydraulic actuator engaged, on a side, with the thrusting portion of the tamping hammer and, on the other side, with an abutment portion, the actuator comprising at least one first and one second sections axially aligned and engaged with each other, one of said first and second sections being engaged with the abutment portion while the other being engaged with the thrusting portion of the tamping hammer, the first section being extendable and configured for moving the hammer at least between the working condition and the receiving or exclusion condition, and vice versa, the second section being configured for being powered by distributing means having cyclic alternating functioning for enabling the tamping hammer to vibrate, the second section comprising at least one jacket extending between a first and second longitudinal ends and at least one piston slidingly moveable inside the jacket, wherein the jacket is closed at the first and second longitudinal ends, the piston having an overall axial size defined by respective opposite thrusting faces of the piston itself, which is entirely contained inside the jacket, wherein the piston comprises only a head entirely contained in the jacket, the piston is devoid of a stem and does not exhibit parts projecting from the longitudinal ends of the jacket.

31. The machine according to claim 30, wherein the pair of tamping hammers are connected and moved by a single actuator which has the first section engaged with a hammer thrusting portion, and the second section connected to the other tamping hammer; or said machine comprises at least two hydraulic actuators, each dedicated to move a tamping hammer of said pair of hammers, each of said actuators being engaged, on a side, with the frame and, on the other side, with the thrusting portion of a tamping hammer, one of said first and second sections of each actuator being engaged with the frame while the other being engaged with the thrusting portion of the tamping hammer.

32. The machine according to claim 30, comprising at least one transducer engaged on the actuator and configured generating a signal regarding at least the movement and the force expressed by the same actuator, and wherein the machine comprises at least one control unit connected to the transducer and configured for receiving the signal from the latter and monitoring at least one of the following actuator conditions:

the position of the tamping hammer with respect to the frame or with respect to another hammer, the vibration speed of the actuator, the force imposed by the actuator and therefore the strain for tamping the ballast, wherein the control unit is connected to the power supply of the actuator and to the hydraulic control means, the control unit being configured for managing the operation of the power supply and of the control hydraulic means for managing and controlling the movement and operation of the first and second sections of the actuator.

33. The machine according to claim 30, wherein the piston is devoid of a stem and does not exhibit parts projecting from the longitudinal ends of the jacket, and wherein the piston of the second section comprises a cylindrical body longitudinally delimited by the respective faces of the of the first and seconds ends of the same piston which define the respective thrusting faces of this latter, the opposite thrusting faces of the piston of the second section exhibiting substantially the same thrusting surface.

34. The machine according to claim 30, wherein the second section comprises at least one connecting element stably constrained to and transversally emerging from the piston of the second section itself, the jacket of the second section comprising at least one longitudinal through groove arranged on a lateral wall of said jacket between the first and second longitudinal ends of the same, the connecting element of the piston passing through and being slidingly axially engaged inside the longitudinal groove, and wherein the jacket of the first section comprises at least one anchoring portion engaged with the connecting element of the second section, the jacket of the first section being, with the piston and connecting element of the second section, relatively movable with respect to the jacket of said second section.

35. The machine according to claim 30, wherein the jacket, at said first and second longitudinal ends, comprises respective fluid-tight blind plugs, the piston being entirely contained in the jacket and entirely interposed between said blind plugs.

* * * * *